US012582195B2

(12) United States Patent
Ho et al.

(10) Patent No.: US 12,582,195 B2
(45) Date of Patent: Mar. 24, 2026

(54) SOLE STRUCTURE FOR ARTICLE OF FOOTWEAR

(71) Applicant: NIKE, Inc., Beaverton, OR (US)

(72) Inventors: Lai Wa C. Ho, Beaverton, OR (US); Jonathan Kosenick, Portland, OR (US); Wil Sixour, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/619,619

(22) Filed: Mar. 28, 2024

(65) Prior Publication Data

US 2024/0237782 A1 Jul. 18, 2024

Related U.S. Application Data

(63) Continuation of application No. 17/330,878, filed on May 26, 2021, now Pat. No. 11,963,578.

(Continued)

(51) Int. Cl.
*A43B 13/20* (2006.01)
*A43B 13/18* (2006.01)

(52) U.S. Cl.
CPC ..... *A43B 13/20* (2013.01); *A43B 13/181* (2013.01)

(58) Field of Classification Search
CPC ..... A43B 3/0036; A43B 5/06; A43B 7/1405; A43B 7/144; A43B 7/148; A43B 7/1485;

(Continued)

(56) References Cited

U.S. PATENT DOCUMENTS 5,343,639 A 9/1994 Kilgore et al.
5,713,141 A 2/1998 Mitchell et al.

(Continued)

FOREIGN PATENT DOCUMENTS

KR 100900156 B1 6/2009
WO WO-2017053654 A1 3/2017
WO WO-2019118533 A1 6/2019

OTHER PUBLICATIONS

European Patent Office, PCT International Search Report and Written Opinion dated Sep. 10, 2021 for application No. PCT/US2021/034210.

(Continued)

*Primary Examiner* — Jameson D Collier
*Assistant Examiner* — Matthew R Marchewka
(74) *Attorney, Agent, or Firm* — Honigman LLP; Matthew H. Szalach; Jonathan P. O'Brien

(57) ABSTRACT

An article of footwear includes a sole structure having a chassis and a bladder. The chassis includes a cavity and a plurality of pillars extending into the cavity. The bladder is disposed within the cavity and includes one or more chambers. Each of one or more chambers is supported by at least one of the pillars. The chassis may include a first plurality of the pillars extending from a first side of the cavity and a second plurality of the pillars extending towards the first plurality of the pillars from a second side of the cavity, whereby the bladder is supported between the first plurality of the pillars and the second plurality of the pillars. The one or more chambers of the bladder includes an interior chamber and a peripheral chamber at least partially surrounding the interior chamber and the peripheral chamber has a different pressure than the interior chamber.

20 Claims, 28 Drawing Sheets

Related U.S. Application Data

(60) Provisional application No. 63/032,421, filed on May 29, 2020.

(58) Field of Classification Search
CPC ..... A43B 13/12; A43B 13/125; A43B 13/14; A43B 13/16; A43B 13/18; A43B 13/181; A43B 13/186; A43B 13/20; A43B 13/206; A43B 13/37; A43B 21/24; A43B 21/26; A43B 21/28; A43B 21/32
USPC ..... 36/28, 29, 35 R
See application file for complete search history.

(56) References Cited

U.S. PATENT DOCUMENTS

| | | | | |
|---|---|---|---|---|
| 5,799,417 | A | 9/1998 | Burke et al. | |
| 5,952,065 | A | 9/1999 | Mitchell et al. | |
| 6,457,261 | B1 * | 10/2002 | Crary | A43B 13/181 36/137 |
| 6,487,796 | B1 | 12/2002 | Avar | |
| 6,568,102 | B1 | 5/2003 | Healy et al. | |
| 6,582,786 | B1 | 6/2003 | Bonk et al. | |
| 7,401,418 | B2 | 7/2008 | Wyszynski et al. | |
| 7,673,397 | B2 | 3/2010 | Jarvis | |
| 2003/0061732 | A1 | 4/2003 | Turner | |
| 2003/0208929 | A1 | 11/2003 | Lucas et al. | |
| 2004/0123493 | A1 | 7/2004 | Russell | |
| 2004/0194347 | A1 * | 10/2004 | Aveni | A43B 7/1464 36/91 |
| 2005/0102859 | A1 | 5/2005 | Yen | |
| 2005/0166422 | A1 | 8/2005 | Schaeffer et al. | |
| 2006/0112592 | A1 | 6/2006 | Leedy et al. | |
| 2007/0022631 | A1 * | 2/2007 | Ho | A43B 13/181 36/29 |
| 2007/0033831 | A1 | 2/2007 | Aveni | |
| 2007/0113425 | A1 * | 5/2007 | Wakley | A43B 13/20 36/28 |
| 2007/0193065 | A1 * | 8/2007 | Nishiwaki | A43B 21/265 36/35 B |
| 2008/0263894 | A1 | 10/2008 | Nakano | |
| 2009/0158622 | A1 | 6/2009 | Cook et al. | |
| 2010/0107444 | A1 * | 5/2010 | Aveni | A43B 13/189 36/35 B |
| 2011/0314695 | A1 | 12/2011 | Tsai | |
| 2012/0060395 | A1 * | 3/2012 | Blevens | A43B 13/18 36/35 R |
| 2013/0160327 | A1 * | 6/2013 | Peyton | A43B 13/04 36/103 |
| 2020/0154825 | A1 | 5/2020 | Case et al. | |
| 2020/0245718 | A1 | 8/2020 | Lesecq | |
| 2020/0305551 | A1 | 10/2020 | Campos, II et al. | |

OTHER PUBLICATIONS

USPTO, Final Office Action for U.S. Appl. No. 17/330,878, mailed Sep. 8, 2023.

USPTO, Non-Final Office Action for U.S. Appl. No. 17/330,878, mailed Mar. 14, 2023.

* cited by examiner

SOLE STRUCTURE FOR ARTICLE OF FOOTWEAR

CROSS REFERENCE TO RELATED APPLICATIONS

This application is a continuation of U.S. application Ser. No. 17/330,878, filed on May 26, 2021, which claims priority under 35 U.S.C. § 119(e) to U.S. Provisional Application No. 63/032,421, filed on May 29, 2020. The disclosures of these prior applications are considered part of the disclosure of this application and are hereby incorporated by reference in their entirety.

FIELD

The present disclosure relates generally to sole structures for articles of footwear, and more particularly, to sole structures incorporating a bladder.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
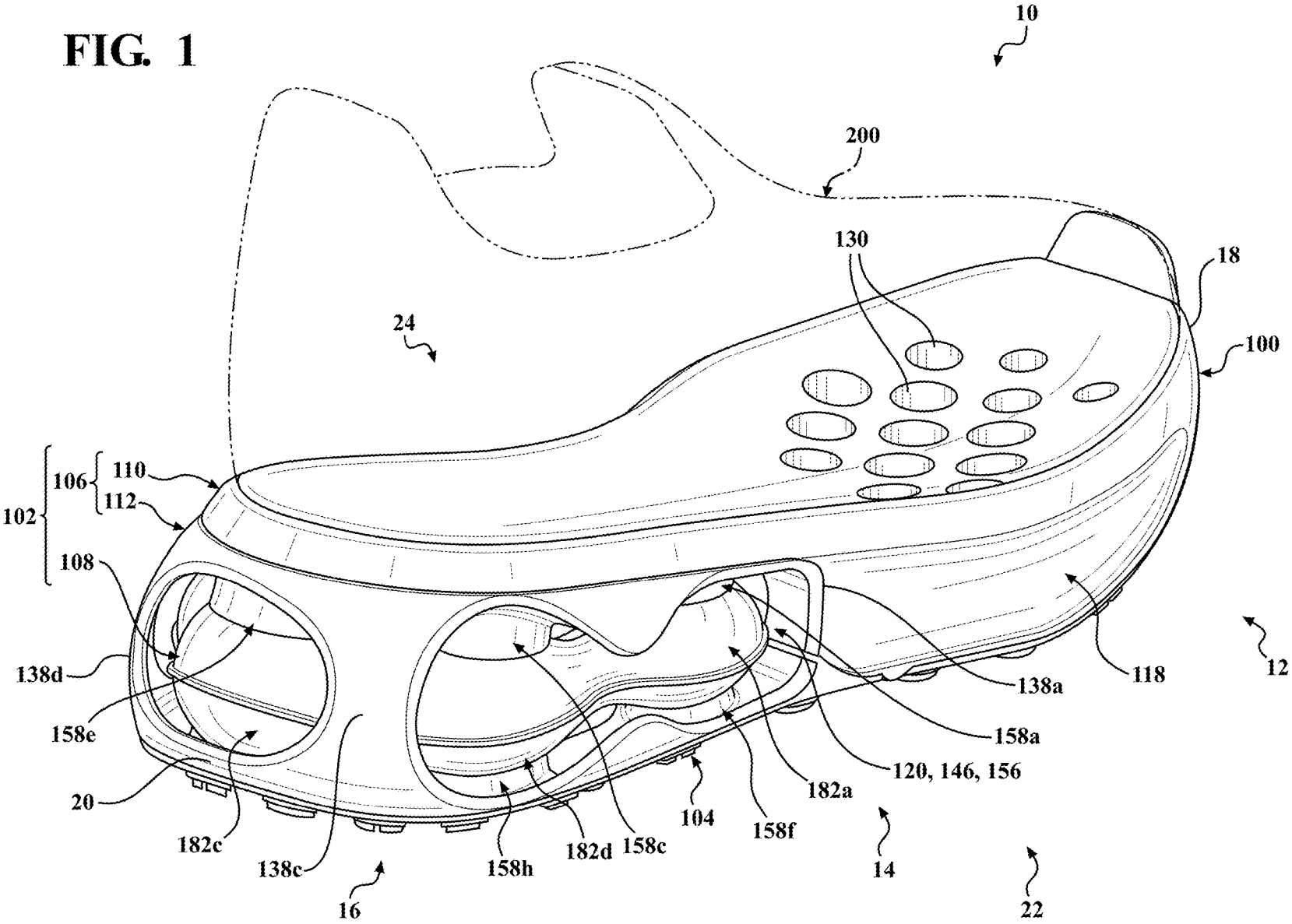
FIG. 1 is a side perspective view of a sole structure for an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a chassis having a cavity and a plurality of pillars extending into the cavity. The sole structure also includes a bladder disposed within the cavity and including one or more chambers, each of the one or more chambers supported by at least one of the pillars. Implementations of the disclosure may include one or more of the following optional features.

In some examples, the chassis includes a first plurality of the pillars extending from a first side of the cavity and a second plurality of the pillars extending towards the first plurality of the pillars from a second side of the cavity. Here, the bladder may be supported between the first plurality of the pillars and the second plurality of the pillars.

In some implementations, the one or more chambers of the bladder includes an interior chamber and a peripheral chamber at least partially surrounding the interior chamber. Optionally, the peripheral chamber has a different pressure than the interior chamber. In some examples, the plurality of pillars includes an interior pillar interfacing with the interior chamber, and a plurality of peripheral pillars interfacing with the peripheral chamber.

In some configurations, the bladder includes a plurality of lobes, each of the lobes supported by a respective one of the pillars. Optionally, each of the lobes is supported between a pair of the pillars.

In some examples, the chassis includes a cushioning element including at least one of the pillars and a cradle including two or more of the pillars. Here, the cushioning element may be formed of a first material and the cradle may be formed of a second material having a greater hardness than the first material.

In another aspect of the disclosure, a sole structure for an article of footwear is provided and includes a cushioning element and a cradle at least partially received within the cushioning element. The cradle defines a portion of a cavity and includes a plurality of first pillars extending into the cavity. A bladder is at least partially received within the cradle and includes one or more chambers supported by the plurality of first pillars. Implementations of this aspect of the disclosure may include one or more of the following optional features.

In some examples, the cradle includes a first plurality of the first pillars extending from a first side of the cradle and a second plurality of the first pillars extending towards the first plurality of the first pillars from a second side of the cradle. Here, the bladder may be supported between the first plurality of the first pillars and the second plurality of the first pillars.

In some configurations, the one or more chambers of the bladder includes an interior chamber and a peripheral chamber at least partially surrounding the interior chamber. Optionally, the peripheral chamber has a different pressure than the interior chamber.

In some implementations, the plurality of first pillars includes a plurality of first pillars arranged in a peripheral region of the sole structure. In some examples, the bladder includes a plurality of lobes, each of the lobes being supported by a respective one of the first pillars. Optionally, each of the lobes is supported between a pair of the first pillars.

In some configurations, the cushioning element includes a second pillar disposed in an interior region of the sole structure, the plurality of first pillars supporting a first one of the chambers of the bladder and the second pillar supporting a second one of the chambers of the bladder. In some examples, the cushioning element is formed of a first material and the cradle is formed of a second material having a greater hardness than the first material.

The details of one or more implementations of the disclosure are set forth in the accompanying drawings and the description below. Other aspects, features, and advantages will be apparent from the description and drawings, and from the claims.

Figure 3:
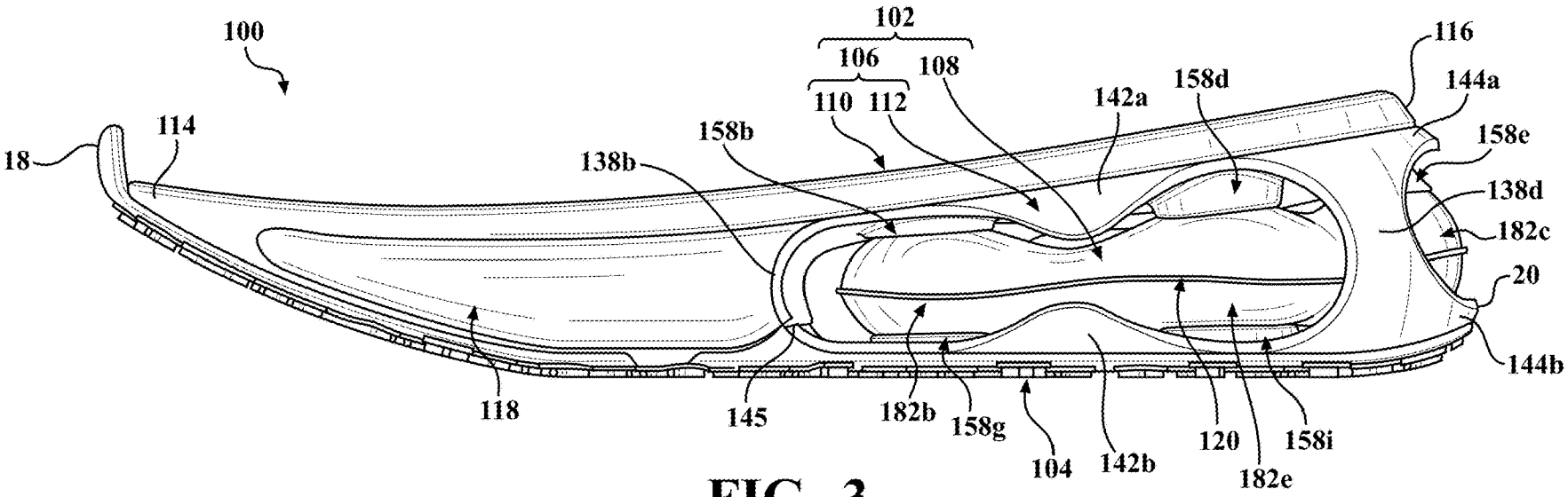
FIG. 3 is a medial side elevation view of the sole structure of FIG. 1.
Figure 4:
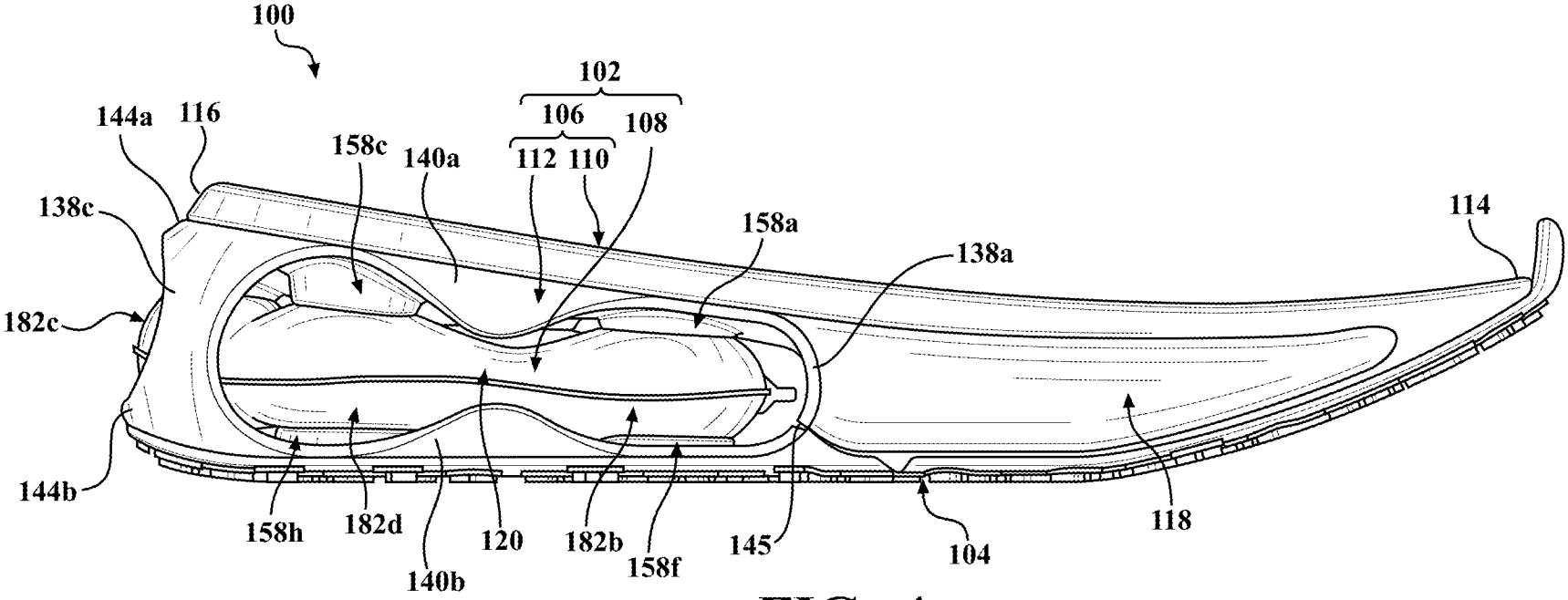
FIG. 4 is a lateral side elevation view of the sole structure of FIG. 1.
Figure 5:
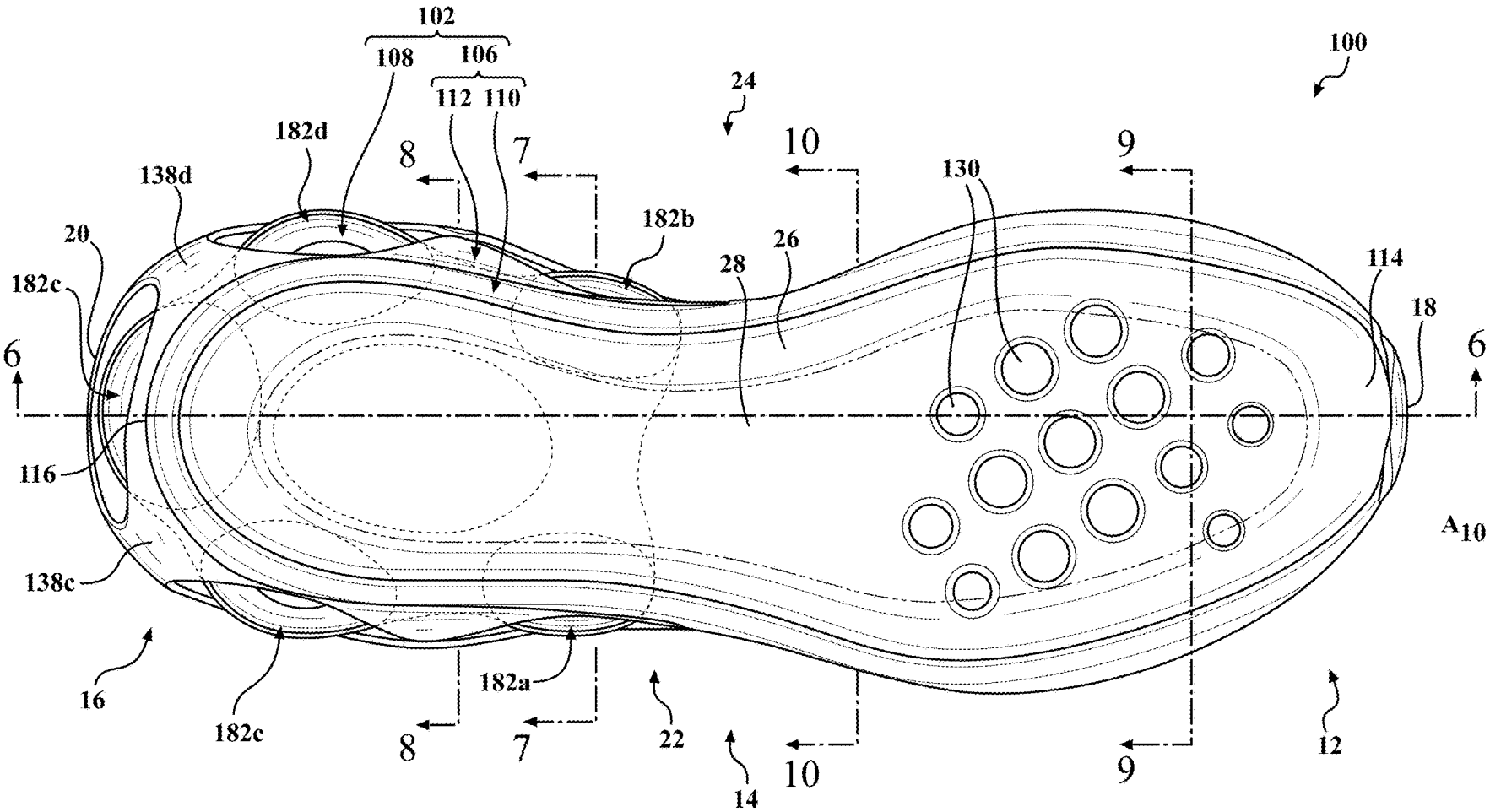
FIG. 5 is a top plan view of the sole structure of FIG. 1.

Referring to FIGS. 1-10, a sole structure 100 for an article of footwear 10 including an upper 200 is provided. The article of footwear 10 may be divided into one or more regions. The regions may include a forefoot region 12, a mid-foot region 14, and a heel region 16. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a lateral side 22 and a medial side 24, as shown in FIG. 5. Accordingly, the lateral side 22 and the medial side 24 respectively correspond with opposite sides of the footwear 10 and extend through the regions 12, 14, 16.

The article of footwear 10, and more particularly, the sole structure 100, may be further described as including a peripheral region 26 and an interior region 28, as indicated in FIG. 5. The peripheral region 26 is generally described as being a region between the interior region 28 and an outer perimeter of the sole structure 100. Particularly, the peripheral region 26 extends from the forefoot region 12 to the heel region 16 along each of the lateral side 22 and the medial side 24, and wraps around each of the forefoot region 12 and the heel region 16. Thus, the interior region 28 is circumscribed by the peripheral region 26, and extends from the forefoot region 12 to the heel region 16 along a central portion of the sole structure 100.

Figure 2A:
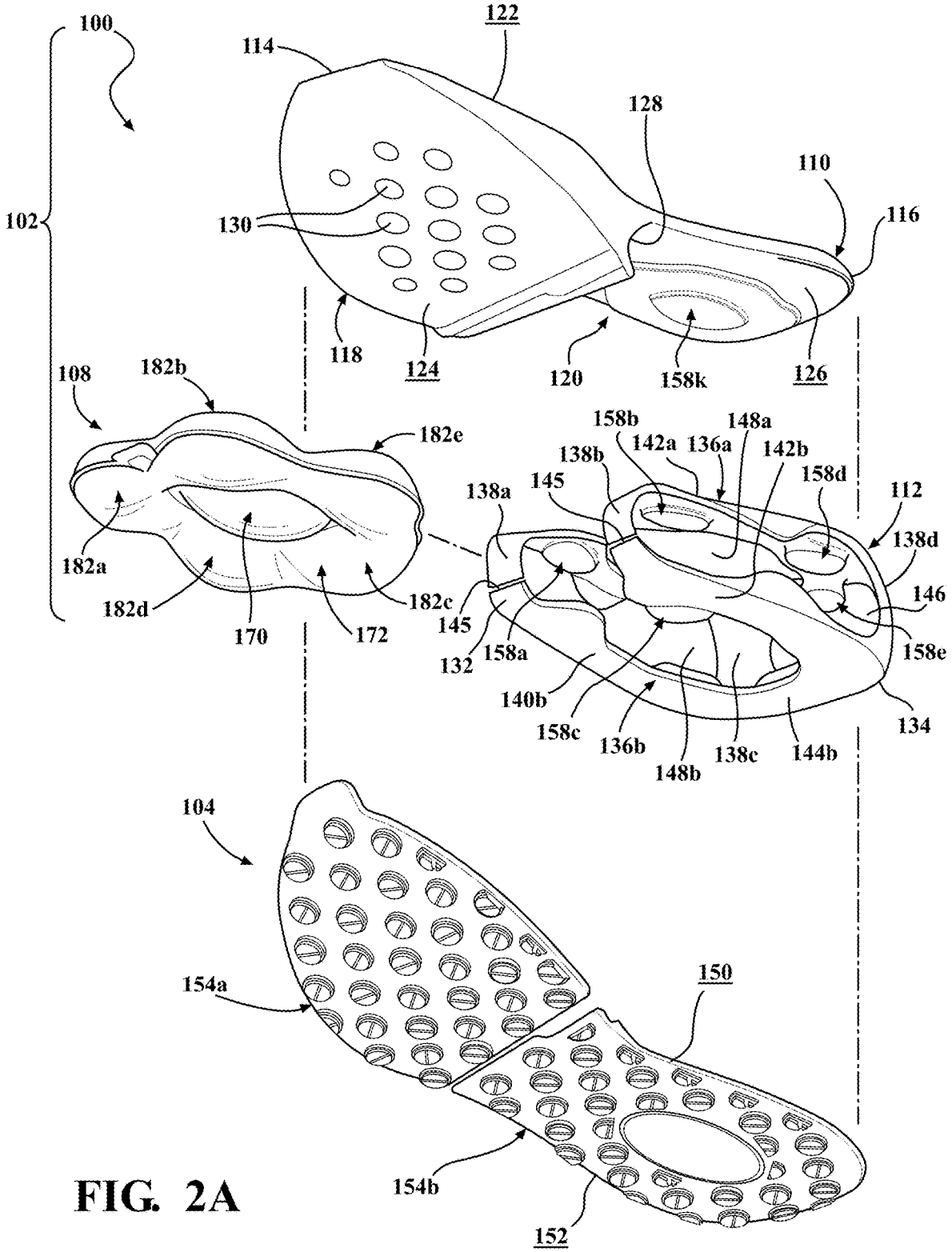
FIG. 2A is an exploded bottom perspective view of the sole structure of FIG. 1.
Figure 2B:
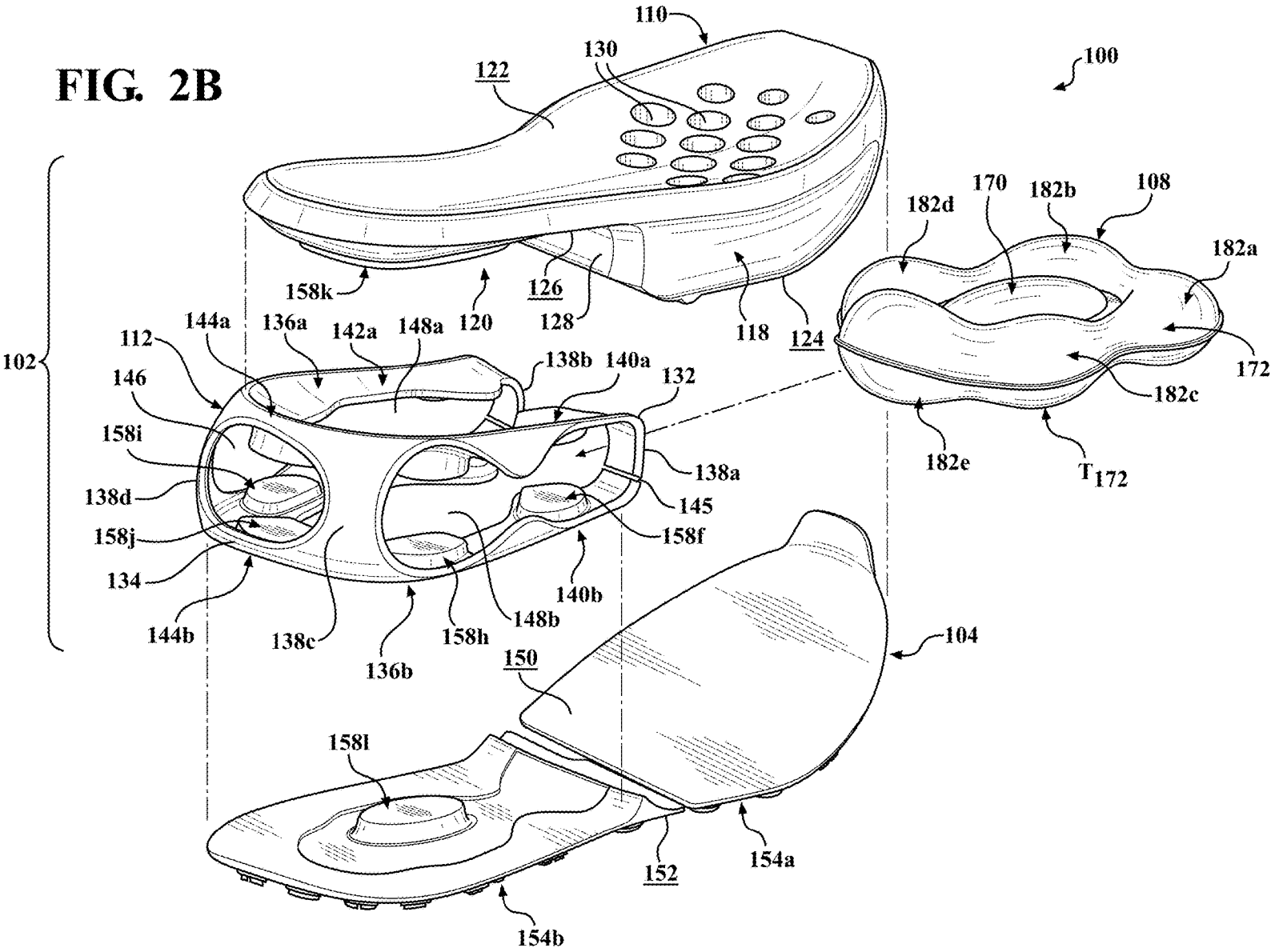
FIG. 2B is an exploded top perspective view of the sole structure of FIG. 1.

With reference to FIGS. 1-2B, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a chassis 106 and a bladder 108, where the chassis 106 is configured to be attached to the upper 200 and provides an interface between the upper 200, the bladder 108, and the outsole 104.

In the illustrated example, the chassis 106 extends continuously from the anterior end 18 to the posterior end 20, and is configured to receive and support the bladder 108 therein. In some examples, the chassis 106 is formed as a composite structure including a cushioning element 110 and a cradle 112 received at least partially within the cushioning element 110. While the cushioning element 110 and the cradle 112 of the illustrated example are shown as separate components that cooperate to form the chassis 106, in some examples the chassis 106 may be formed as a unitary body.

The cushioning element 110 is formed of a first material, and extends continuously from a first end 114 at the anterior end 18 to a second end 116 at the posterior end 20. As shown, the cushioning element 110 may be generally described as including a forefoot support member 118 configured to provide a first region of cushioning to the chassis 106, and a recess 120 configured to receive and interface with the bladder 108 for providing a second region of cushioning to the chassis 106. In the illustrated example, the cushioning element 110 includes a top surface 122 of the chassis 106 that defines a footbed of the sole structure 100 extending continuously from the anterior end 18 to the posterior end 20. A bottom surface 124 of the cushioning element 110 is formed on an opposite side of the cushioning element 110 from the top surface 122, and extends from the anterior end 18 of the sole structure 100. Here, the bottom surface 124 of the cushioning element 110 extends along a first portion of the sole structure 100 in the forefoot region 16, and terminates in the mid-foot region 14.

In the illustrated example, the recess 120 is formed in the heel region 16 of the cushioning element 110 and is configured to receive the cradle 112 and the bladder 108 therein. Here, the recess 120 extends through each of the bottom surface 124 and the second end 116 of the cushioning element 110, such that the recess 120 provides the cushioning element 110 with a stepped profile. However, in other examples, the recess 120 may be contained at least partially within the cushioning element 110. For instance, the recess 120 may be formed between the top surface 122 and the bottom surface 124 and/or between the first end 114 and the second end 116.

With reference to FIGS. 2A and 2B, the recess 120 of the illustrated example is defined by an upper surface 126 and end wall 128. The upper surface 126 is formed on an opposite side (i.e., faces away) from the top surface 122 of the cushioning element 110, and is offset from the bottom surface 124 by a distance corresponding to a height of the cradle 112. Accordingly, when the cradle 112 is received within the recess 120, a bottom portion of the cradle 112 is flush with the bottom surface 124 of the forefoot support member 118 to define a bottom support surface of the chassis 106, as discussed in greater detail below. The end wall 128 extends between the upper surface 126 and the bottom surface 124, and forms an anterior end of the recess 120 in the mid-foot region 14.

The cushioning element 110 may further include one or more apertures 130 formed through a thickness of the cushioning element 110 in the forefoot region 12, from the top surface 122 to the bottom surface 124. In the illustrated example, the apertures 130 are formed in the forefoot region 12 to provide a modified compressibility to the cushioning element 110. For instance, where the bladder 108 provides the heel region 16 of the sole structure 100 with a relatively soft feel, the apertures 130 may be formed through the forefoot region 12 of the cushioning element 110 to provide a comparable feel in the forefoot region 12.

As described above, the cushioning element 110 is formed of a resilient polymeric material, such as foam or rubber, to impart properties of cushioning, responsiveness, and energy distribution to the foot of the wearer. Example resilient polymeric materials for the cushioning element 110 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, ethylene-vinyl alcohol (EVOH) copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed below for the barrier layers 168. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury® mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to FIGS. 1-2B, the cradle 112 is received within the recess 120 of the cushioning element 110, and cooperates with the cushioning element 110 and the outsole 104 to support the bladder 108. In the illustrated example, the cradle 112 extends from a first end 132 to a second end 134. When the sole structure 100 is assembled, the first end 132 of the cradle 112 is disposed adjacent to and faces the end wall 128 of the recess 120, while the second end 134 is aligned with the second end 116 of the cushioning element 110 at the posterior end 20 of the sole structure 100. However, as discussed above, in examples where the recess 120 is disposed within the cushioning element 110, such as between the first end 114 and the second end 116, the cradle 112 will also be contained within the cushioning element 110.

Figure 13:
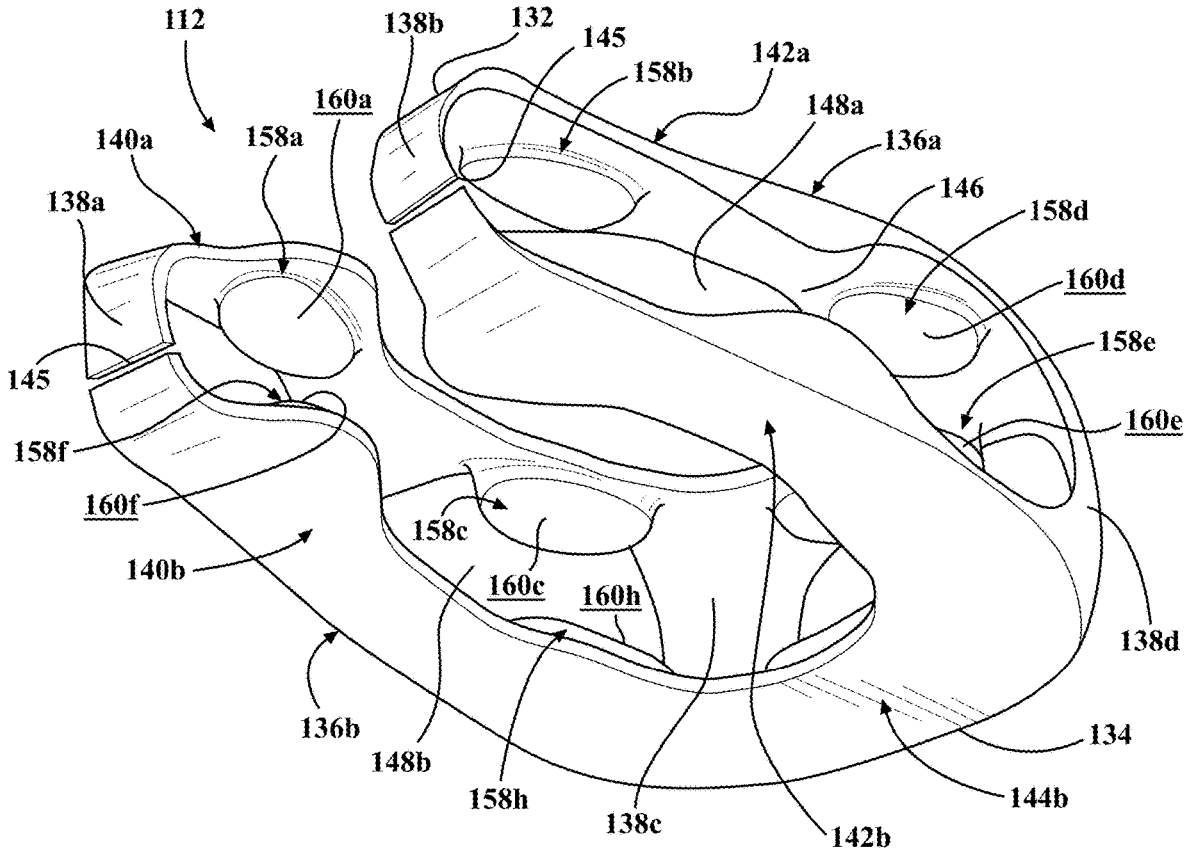
FIG. 13 is a bottom perspective view of a cradle for a sole structure in accordance with principles of the present disclosure.
Figure 14:
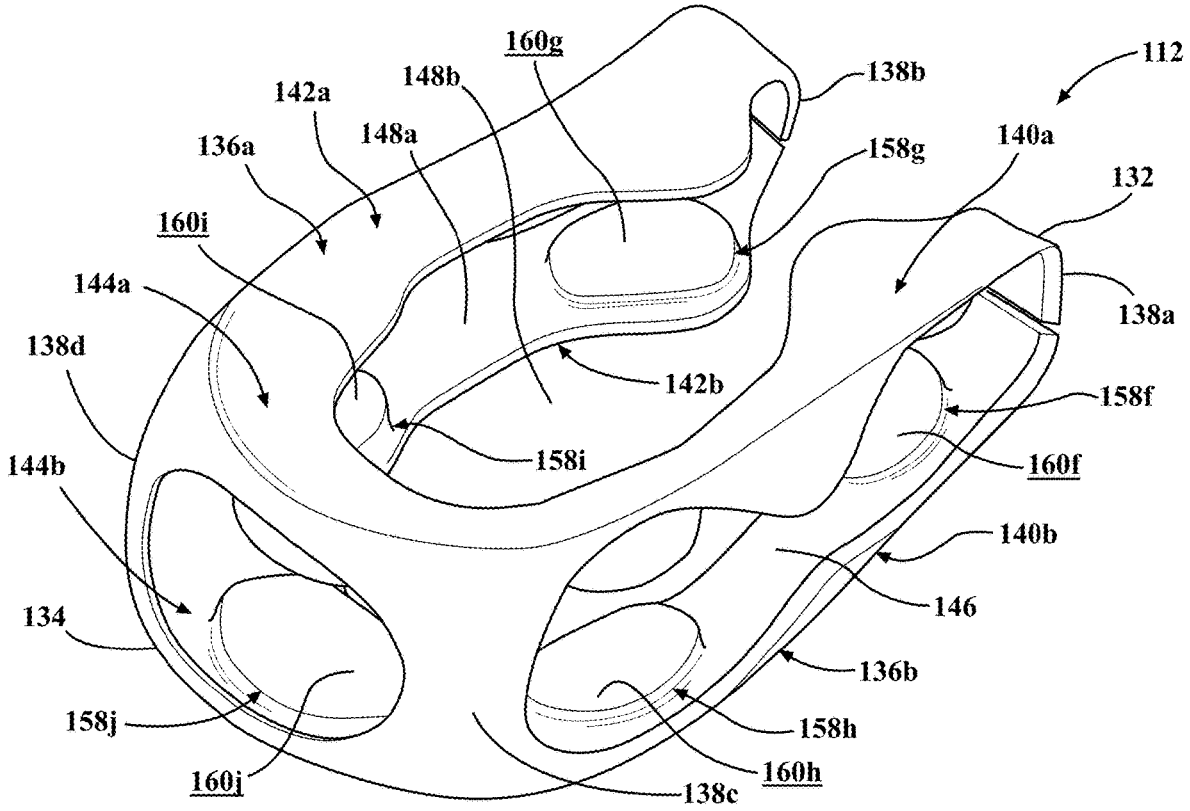
FIG. 14 is a top perspective view of a cradle for a sole structure in accordance with principles of the present disclosure.

As best shown in FIGS. 13 and 14, the cradle 112 includes a pair of substantially parallel (i.e., not intersecting) rails 136*a*, 136*b* vertically spaced apart from and connected to each other by one or more braces 138*a*-138*d*. In the illustrated example, the rails 136*a*, 136*b* include an upper rail 136*a* forming an upper portion of the cradle 112 and a lower rail 136*b* forming a lower portion of the cradle 112. Each of the upper rail 136*a* and the lower rail 136*b* extends along a U-shaped path and includes an elongate lateral segment 140*a*, 140*b*, an elongate medial segment 142*a*, 142*b* laterally spaced apart from and parallel to the respective lateral segment 140*a*, 140*b*, and a connecting segment 144*a*, 144*b* extending between and connecting the respective lateral segments 140*a*, 140*b* and medial segments 142*a*, 142*b*. Accordingly, the upper segments 140*a*, 142*a*, 144*a* cooperate to form the upper rail 136*a*, and the lower segments 140*b*, 142*b*, 144*b* cooperate to form the lower rail 136*b*.

In the illustrated example, the upper rail 136*a* is spaced apart from and connected to the lower rail 136*b* by a plurality of the braces 138*a*-138*d*. Particularly, a first brace 138*a* extends between and connects respective ends of the lateral segments 140*a*, 140*b* on a first side of the cradle 112 at the first end 132. Similarly, a second brace 138*b* extends between and connects respective ends of the medial segments 142*a*, 142*b* on a second side of the cradle 112 at the first end 132. The cradle 112 further includes a third brace 138*c* and a fourth brace 138*d* connecting the upper rail 136*a* to the lower rail 136*b* at the second end 134 of the cradle 112. Here, the third brace 138*c* extends from a first end attached to the upper rail 136*a* between the lateral segment 140*a* and the connecting segment 144*a* of the upper rail 136*a*, to a second end attached to the lower rail 136*b* between the lateral segment 140*b* and the connecting segment 144*b* of the lower rail 136*b*. Similarly, the fourth brace 138*d* extends from a first end attached to the upper rail 136*a* between the medial segment 142*a* and the connecting segment 144*a* of the upper rail 136*a*, to a second end attached to the lower rail 136*b* between the medial segment 142*b* and the connecting segment 144*b* of the lower rail 136*b*.

Optionally, one or more of the braces 138*a*-138*d* may include a separation or split 145 to allow an upper portion of the brace 138*a*-138*d* to be pulled apart from a lower portion of the brace 138*a*-138*d*. For instance, in the illustrated example, the first brace 138*a* and the second brace 138*b* each include a split 145. Here, the splits 145 formed through the braces 138*a*, 138*b* at the first end 132 of the cradle 112 allow the upper rail 136*a* and the lower rail 136*b* to be pulled apart from each other at the first end 132 of the cradle 112, where the third and fourth braces 138*c*, 138*d* act as living hinges at the second end 134 of the cradle 112. This configuration allows the cradle 112 to be opened from the first end 132 so that the bladder 108 can be more easily inserted into the cradle 112.

As shown, the rails 136*a*, 136*b* and the braces 138*a*-138*d* cooperate to define a void 146 of the cradle 112 for receiving at least a portion of the bladder 108 therein. Particularly, the void 146 is formed between the upper and lower rails 136*a*, 136*b* and is surrounded by the braces 138*a*-138*d*. The cradle 112 may further include upper and lower openings 148*a*, 148*b*, which are respectively defined by the rails 136*a*, 136*b*. Particularly, the cradle 112 includes an upper opening 148*a* formed in the interior region 28 and surrounded by the upper rail 136*a*, and a lower opening 148*b* formed in the interior region 28 and surrounded by the lower rail 136*b*. Because the rails 136*a*, 136*b* are U-shaped, the openings 148*a*, 148*b* extend continuously through the first end 132 of the cradle 112. However, in some examples, the lateral segments 140*a*, 140*b* may be connected to the medial segments 142*a*, 142*b* at the first end 132, such that the openings 148*a*, 148*b* are completely surrounded.

In examples where the chassis 106 is formed as a composite structure including the cushioning element 110 and the cradle 112, the cushioning element 110 and the cradle 112 may be formed of materials having different properties. For example, the cushioning element 110 may include first materials configured to provide desired levels of cushioning and impact attenuation, while the cradle 112 is formed of one or more materials configured to impart a greater degree of stiffness to the heel region 16 of the chassis 106. In some examples, the cushioning element 110 may be formed of or include a resilient and compressible first material, discussed above, and the cradle 112 may include or be formed of a second material having a greater stiffness and/or hardness than the first material.

With continued reference to FIGS. 2A and 2B, the outsole 104 is configured to be attached to the midsole 102 to provide a durable ground-engaging surface to the sole structure 100. The outsole 104 includes an inner surface 150 that attaches to the forefoot support member 118 and the cradle 112, and an exterior surface 152 formed on an opposite side of the outsole 104 than the inner surface 150. The outsole 104 may be described as including a first portion 154*a* attached to the bottom surface 124 of the cushioning element 110 along the forefoot support member 118, and a second portion 154*b* attached to the lower rail 136*b* of the cradle 112. As shown, the outsole 104 is formed as a unitary structure such that the first portion 154*a* and the second portion 154*b* are attached to each other and effectively connect the bladder 108, the forefoot support member 118 of the cushioning element 110, and the lower rail 136*b* of the cradle 112. Furthermore, the second portion 154*b* of the outsole 104 may be described as enclosing a bottom side of the recess 120 of the cushioning element 110 to define a cavity 156 of the sole structure 100.

In the illustrated example, the sole structure 100 includes a plurality of supports or pillars 158*a*-1581 disposed within the cavity 156 for supporting the bladder 108. The pillars 158*a*-1581 may be formed as part of the cushioning element 110, the cradle 112, and/or the outsole 104. As discussed in greater detail below, each of the pillars 158*a*-1581 protrudes into the cavity 156 from the sole structure 100, and includes a distal end or support surface 160*a*-1601 configured to interface with the bladder 108. Accordingly, when the sole structure 100 is assembled, the pillars 158*a*-1581 contact the bladder 108 at discrete locations within the cavity 156, thereby allowing the bladder 108 to freely expand within the cavity 156 in areas between the pillars 158*a*-1581. The sole structure 100 may include a first plurality of the pillars 158*a*-158*j* configured to support a first portion of the bladder 108 in the peripheral region 26, and one or more pillars 158*k*, 1581 configured to support the bladder 108 in the interior region 28.

As shown in FIGS. 1-5, the sole structure 100 includes a first plurality of upper peripheral pillars 158*a*-158*e* and an upper interior pillar 158*k* protruding in direction away from the upper surface 126 of the recess 120. Thus, the upper support surfaces 160*a*-160*e*, 160*k* of the upper supports face away from the upper surface 126. The sole structure 100 further includes a plurality of lower peripheral pillars 158*f*-158*j* and a lower interior pillar 158*l* disposed on an opposite side of the cavity 156 and protruding towards the upper surface 126 of the recess 120. Accordingly, lower support surfaces 160*f*-160*j*, 1601 of the lower pillars 158*f*-158*j*, 1581 face towards upper support surfaces 160*a*-160*e*, 160*k* of the upper pillars 158*a*-158*e*, 158*k*.

In some examples, the peripheral pillars 158*a*-158*j* are formed by the cradle 112 and the interior pillars 158*k*, 1581 are formed by the cushioning element 110 and the outsole 104, respectively. Thus, peripheral pillars 158*a*-158*j* may be formed of the harder material of the cradle 112, while the interior pillars 158*k*, 1581 are formed of the more resilient or compressible materials of the cushioning element 110 and the outsole 104. When the sole structure 100 is assembled, the rigid peripheral pillars 158*a*-158*j* interface with a peripheral portion of the bladder 108 and the resilient interior pillars 158*k*, 1581 interface with an interior portion of the bladder 108. As discussed below, the first portion of the bladder 108 may be fluidly isolated from the second portion of the bladder 108, and may have a different pressure than the second portion of the bladder 108 such that the bladder 108 provides different characteristics in the peripheral region 26 than in the interior region 28.

As best shown in FIG. 13, the cradle 112 includes the upper peripheral pillars 158*a*-158*e* formed along an inner surface of the upper rail 136*a*. As shown, a first one of the upper peripheral pillars 158*a* is formed on the upper lateral segment 140*a* at the first end 132, a second one of the upper peripheral pillars 158*b* is formed on the upper medial segment 142*a* at the first end 132, a third one of the upper peripheral pillars 158*c* is formed on the upper lateral segment 140*a* adjacent to the upper connecting segment 144*a*, a fourth one of the upper peripheral pillars 158*d* is formed on the upper medial segment 142*a* adjacent to the upper connecting segment 144*a*, and a fifth one of the upper peripheral pillars 158*e* is formed in a central portion of the upper connecting segment 144*a*.

With reference to FIG. 14, the cradle 112 includes the lower peripheral pillars 158*f*-158*j* formed along an inner surface of the lower rail 136*b*. Generally, the lower peripheral pillars 158*f*-158*j* are aligned across the void 146 with corresponding ones of the upper peripheral pillars 158*a*-158*e*. In other words, the upper support surfaces 160*a*-160*e* directly face or oppose the lower support surfaces 160*f*-160*j* so that the bladder 108 is interposed therebetween. As shown, a first one of the lower peripheral pillars 158*f* is formed on the lower lateral segment 140*b* at the first end 132, a second one of the lower peripheral pillars 158*g* is formed on the lower medial segment 142*b* at the first end 132, a third one of the lower peripheral pillars 158*h* is formed on the lower lateral segment 140*b* adjacent to the lower connecting segment 144*b*, a fourth one of the lower peripheral pillars 158*i* is formed on the lower medial segment 142*b* adjacent to the lower connecting segment 144*b*, and a fifth one of the lower peripheral pillars 158*j* is formed in a central portion of the lower connecting segment 144*b*.

Referring now to FIGS. 2A and 2B, the interior pillars 158*k*, 1581 are formed by the cushioning element 110 and the outsole 104, respectively. As best shown in the cross-sections of FIGS. 6 and 8, the interior pillars 158*k*, 1581 extend through the openings 148*a*, 148*b* in the cradle 112 to interface with an interior portion of the bladder 108 when the sole structure 100 is assembled. The upper interior pillar 158*k* is formed as part of the cushioning element 110 and protrudes into the cavity 156 from the upper surface 126 of the recess 120. Accordingly, the upper interior pillar 158*k* is formed of the same material as the cushioning element 110. The lower interior pillar 158*l* is formed as part of the outsole 104 and protrudes into the cavity 156 from the inner surface 150 of the outsole 104. Accordingly, the lower interior pillar 158*l* is formed of the same material as the outsole 104. As such, the bladder 108 is supported by different materials that are aligned with one another in a direction extending between the outsole 104 and the upper 200 at the interior portion of the bladder 108.

Figure 11A:
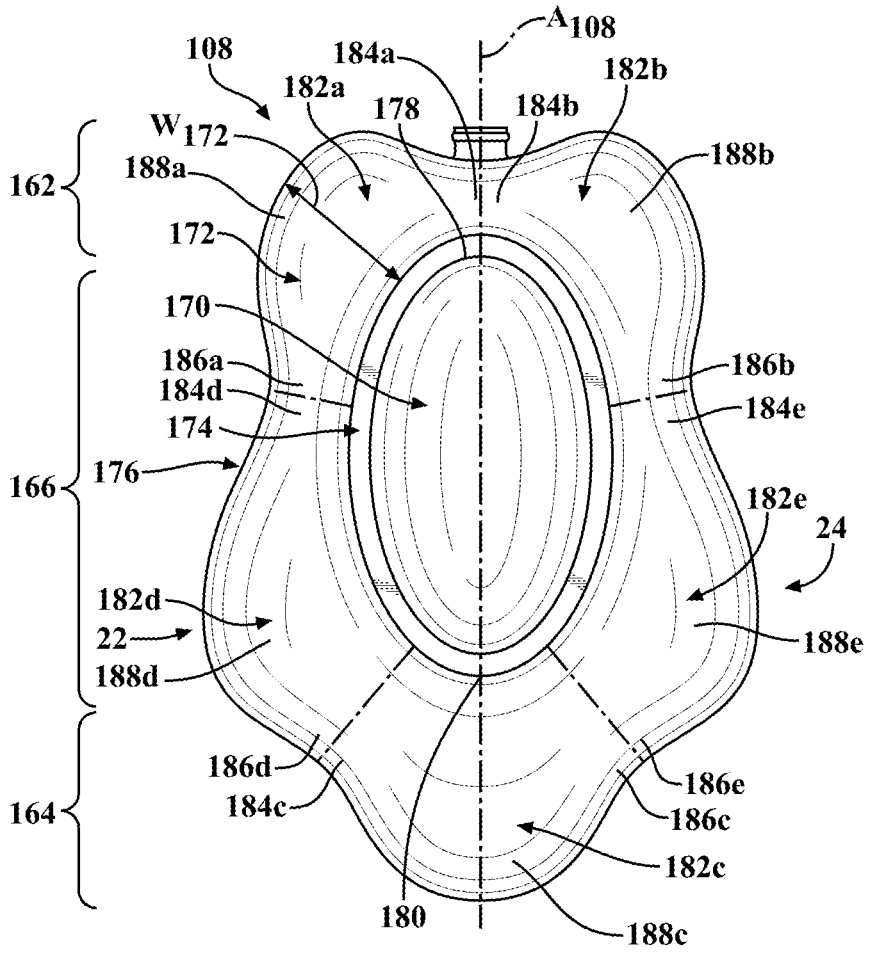
FIGS. 11A and 11B are top plan views of a bladder of a sole structure in accordance with principles of the present disclosure.
Figure 11B:
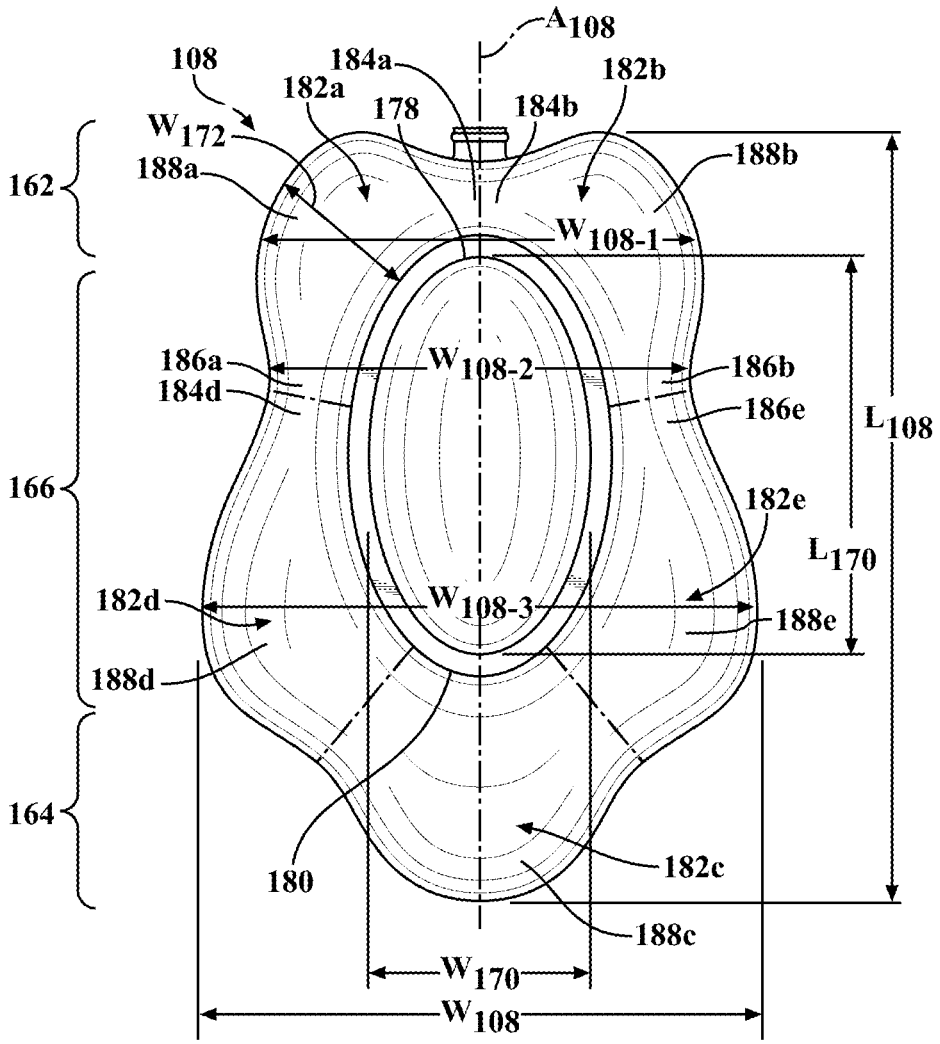
Figure 12:
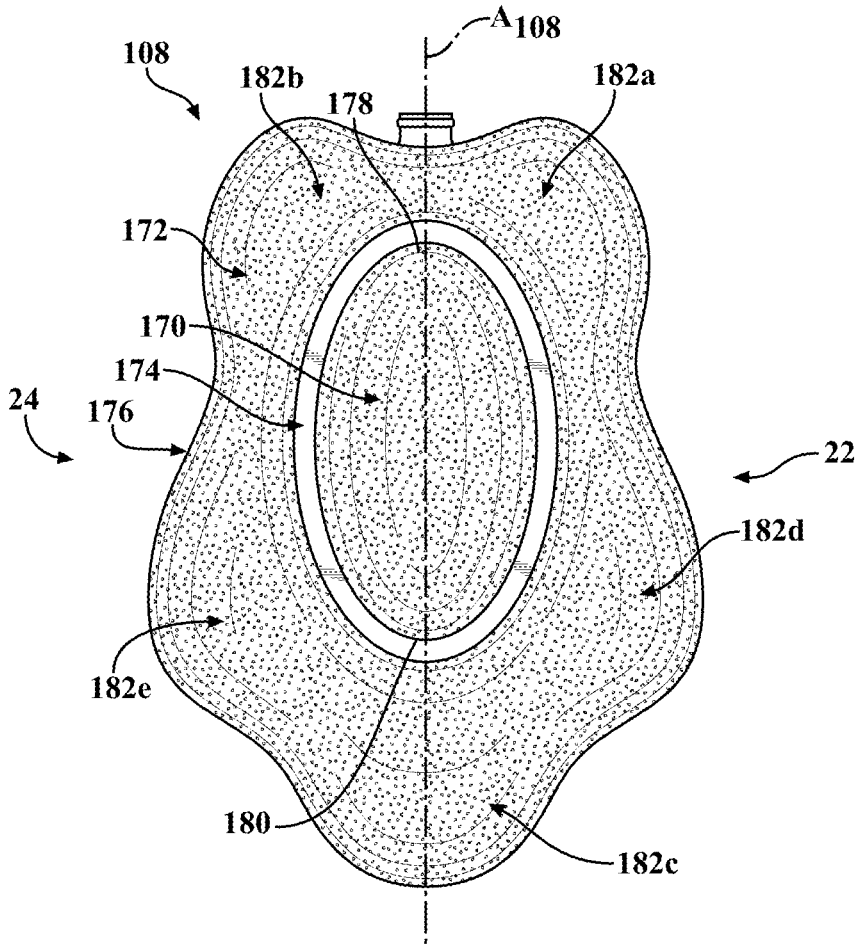
FIG. 12 is a bottom plan view of the bladder of FIGS. 11A and 11B.

With reference to FIGS. 11A-12, the bladder 108 of the midsole 102 may be described as extending along a longitudinal axis $A_{108}$ from a first, anterior end 162 to a second, posterior end 164 disposed at an opposite end of the bladder 108 than the anterior end 162. When incorporated into the article of footwear 10, the anterior end 162 of the bladder 108 is disposed within the heel region 16 or the mid-foot region 14 and faces the anterior end 18 of the sole structure 100, while the posterior end 164 is disposed at the posterior end 20 of the footwear 10. The bladder 108 may be further described as including an intermediate region 166 disposed between the anterior end 162 and the posterior end 164. The geometry and features of the bladder 108 may also be described relative to the peripheral region 26 and the interior region 28 of the article of footwear 10.

Figure 6:
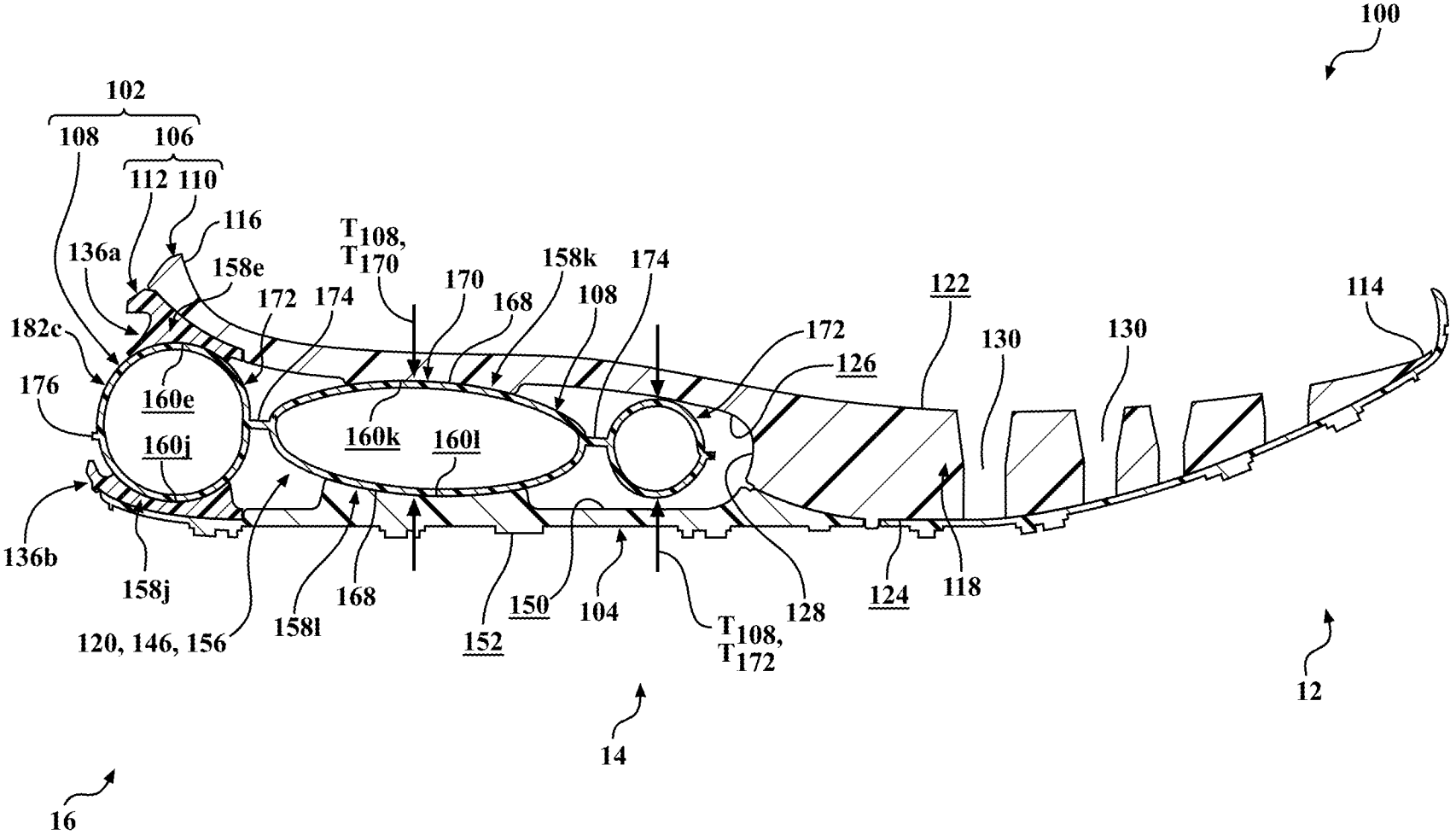
FIG. 6 is a cross-sectional view of the sole structure of FIG. 1, taken along Line 6-6 of FIG. 5.
Figure 7:
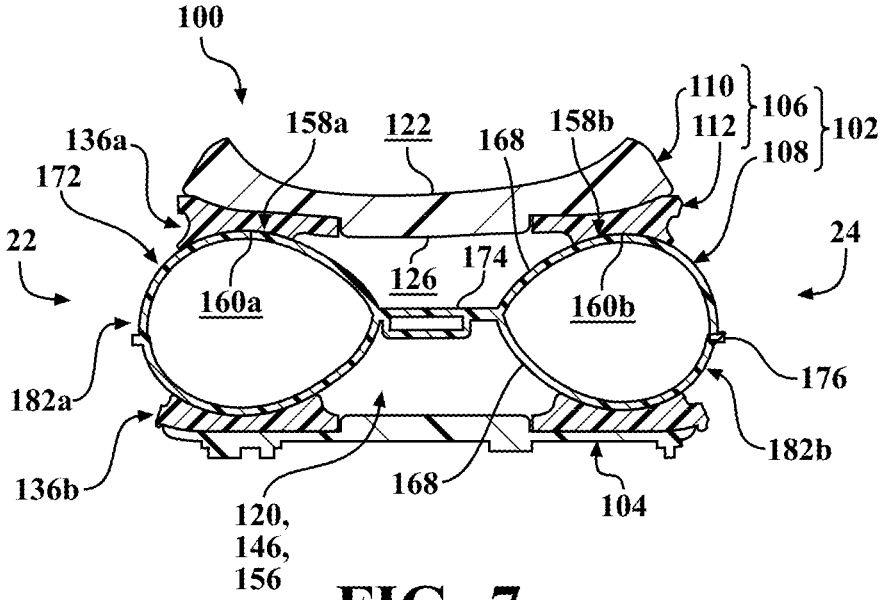
FIG. 7 is a cross-sectional view of the sole structure of FIG. 1, taken along Line 7-7 of FIG. 5.
Figure 8:
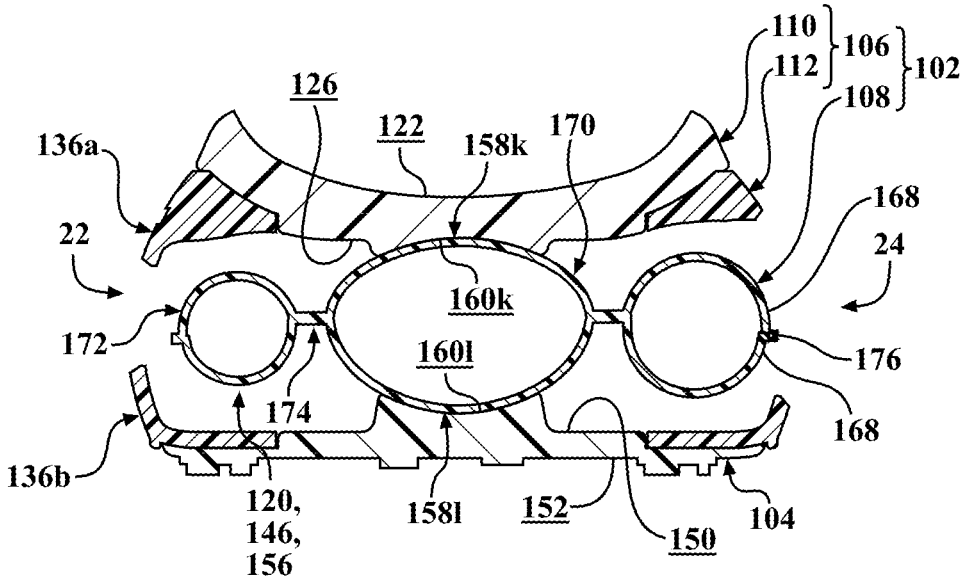
FIG. 8 is a cross-sectional view of the sole structure of FIG. 1, taken along Line 8-8 of FIG. 5.
Figure 9:
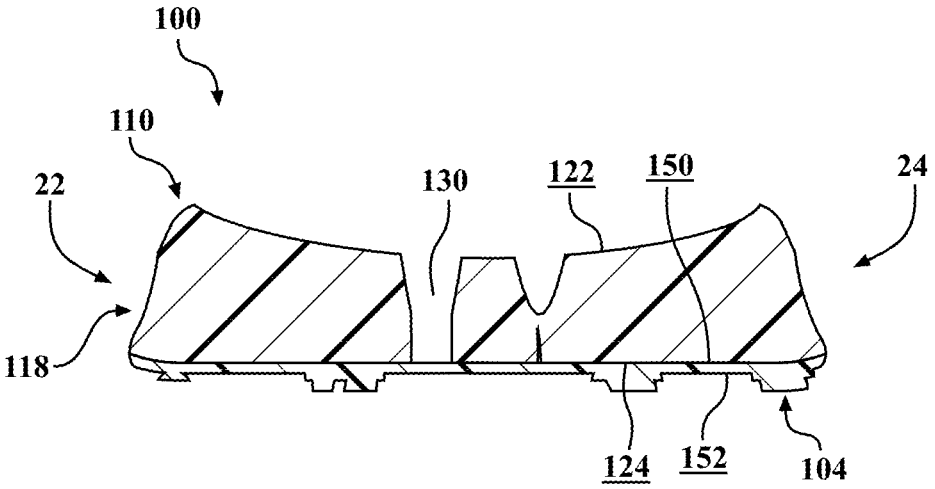
FIG. 9 is a cross-sectional view of the sole structure of FIG. 1, taken along Line 9-9 of FIG. 5.
Figure 10:
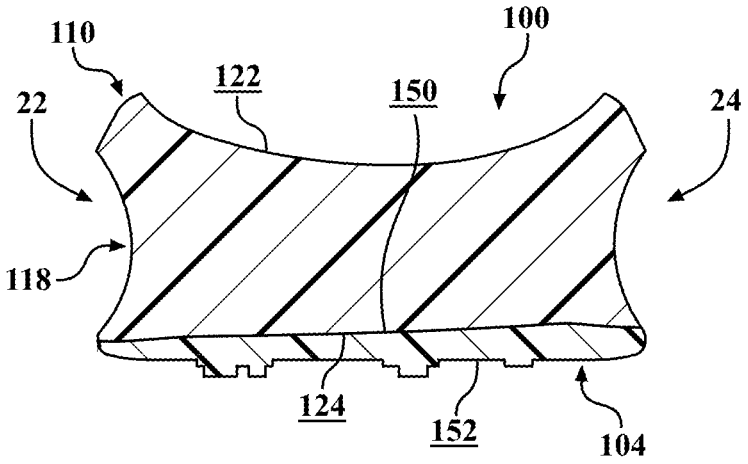
FIG. 10 is a cross-sectional view of the sole structure of FIG. 1, taken along Line 10-10 of FIG. 5.

As shown in the cross-sectional views of FIGS. 6-8, the bladder 108 may be formed by an opposing pair of barrier layers 168, which can be joined to each other at discrete locations to define an overall shape of the bladder 108. Alternatively, the bladder 108 can be produced from any suitable combination of one or more barrier layers. As used herein, the term "barrier layer" (e.g., barrier layers 168) encompasses both monolayer and multilayer films. In some embodiments, one or both of the barrier layers 168 are each produced (e.g., thermoformed or blow molded) from a monolayer film (a single layer). In other embodiments, one or both of the barrier layers 168 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 168 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 168 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including hydrogenated methylene diphenyl diisocyanate (HMDI), TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 168 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 168 include two or more sublayers, examples of suitable multilayer films include microlayer films, such as those disclosed in Bonk et al., U.S. Pat. No. 6,582,786, which is incorporated by reference in its entirety. In further embodiments, the barrier layers 168 may each independently include alternating sublayers of one or more TPU copolymer materials and one or more EVOH copolymer materials, where the total number of sublayers in each of the barrier layers 168 includes at least four (4) sublayers, at least ten (10) sublayers, at least twenty (20) sublayers, at least forty (40) sublayers, and/or at least sixty (60) sublayers.

The bladder 108 can be produced from the barrier layers 168 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 168 can be produced by co-extrusion followed by vacuum thermoforming to form the profile of the bladder 108, which can optionally include one or more valves (e.g., one way valves) that allows the bladder 108 to be filled with the fluid (e.g., gas).

The bladder 108 desirably has a low gas transmission rate to preserve its retained gas pressure. In some embodiments, the bladder 108 has a gas transmission rate for nitrogen gas that is at least about ten (10) times lower than a nitrogen gas transmission rate for a butyl rubber layer of substantially the same dimensions. In an aspect, bladder 108 has a nitrogen gas transmission rate of 15 cubic-centimeter/square-meter·atmosphere·day ($cm^3/m^2$·atm·day) or less for an average film thickness of 500 micrometers (based on thicknesses of barrier layers 168). In further aspects, the transmission rate is 10 $cm^3/m^2$·atm·day or less, 5 $cm^3/m^2$·atm·day or less, or 1 $cm^3/m^2$·atm·day or less.

In the illustrated example, the interior surfaces of the barrier layers 168 are joined together at discrete locations to define a plurality of chambers 170, 172. As shown in FIGS. 6-8, the upper and lower barrier layers 168 are spaced apart from each other to define respective interior voids of each of the chambers 170, 172, while the barrier layers 168 are joined or attached to each other to form a web area 174 and a peripheral seam 176 surrounding each of the chambers 170, 172.

In the illustrated example, the bladder 108 includes a first, interior chamber 170 disposed in the interior region 28 of the bladder 108 and a second, peripheral chamber 172 surrounding the interior chamber 170. The web area 174 surrounds the interior chamber 170 and separates the interior chamber 170 from the peripheral chamber 172 such that the interior voids of the interior chamber 170 and the peripheral chamber 172 are fluidly isolated from each other (i.e., fluid or media cannot transfer between the interior voids). The peripheral seam 176 extends around the outer periphery of the peripheral chamber 172 and defines an outer peripheral profile of the bladder 108.

As shown in FIGS. 11A-12, the interior chamber 170 extends continuously along the longitudinal axis $A_{108}$ of the bladder 108. When incorporated within the article of footwear 10, the interior chamber 170 is configured to support a central portion of the heel corresponding to the bottom of the calcaneus bone, while the peripheral chamber 172 provides a separate support structure that receives a portion of the heel therein.

In the illustrated example, the interior chamber 170 is formed as an ovoid, whereby the upper barrier layer 168 and the lower barrier layer 168 are both convex in shape such that a cross section of the interior chamber 170 tapers along the length $L_{108}$ of the bladder 108. However, in other examples, either or both of the barrier layers 168 may have other geometries, and at least a portion of the interior chamber 170 may have a constant cross-sectional area.

With continued reference to FIGS. 11A-12, the peripheral chamber 172 extends along the peripheral region 26 from the anterior end 162 to the posterior end 164 of the bladder 108. As shown, the peripheral chamber 172 completely surrounds the interior chamber 170 such that the interior void of the peripheral chamber 172 is interminable. As shown, an overall length $L_{108}$ and width $W_{108}$ of the bladder 108 are defined by the peripheral chamber 172, and more particularly, by the peripheral seam 176.

Referring now to FIGS. 6 and 11B, the peripheral chamber 172 is formed with a variable cross-section, such that at least one of a width $W_{172}$ and a thickness $T_{172}$ of the peripheral chamber 172 changes along a length of the peripheral chamber 172. Here, the width $W_{172}$ (FIG. 11B) of the peripheral chamber 172 is defined as a distance across the peripheral chamber 172 from the web area 174 to the peripheral seam 176, while the thickness $T_{172}$ (FIG. 6) is defined by the distances across the barrier layers 168 of the bladder 108.

Referring to FIGS. 11A and 11B, the peripheral chamber 172 may include a plurality of lobes **182*a*-182*e* each forming a portion of the peripheral chamber 172 having a variable cross-sectional area. For example, each of the lobes 182*a*-182*e* includes a first end 184*a*-184*e* having a first cross-sectional area, a second end 186*a*-186*e* having a second cross-sectional area, and an intermediate portion 188*a*-188*e* disposed between the first end 184*a*-184*e* and the second end 186*a*-186*e* and having a third cross-sectional area that is greater than the first cross-sectional area and the second cross-sectional area. Accordingly, each of the lobes 182*a*-182*e* tapers towards the respective first end 184*a*-184*e* and second end 186*a*-186*e* from the intermediate portion 188*a*-188*e*. In some examples, both the width $W_{172}$ and the thickness $T_{172}$ of each of the lobes 182*a*-182*e* tapers from the intermediate portion 188*a*-188*e***.

The illustrated example of the bladder 108 includes a plurality of the lobes **182*a*-182*e* arranged end-to-end in series around the interior chamber 170, such that the cross-sectional area of the peripheral chamber 172 alternates between larger and smaller sizes. As shown, the plurality of the lobes 182*a*-182*e* includes a first pair of anterior lobes 182*a*, 182*b* disposed at the anterior end 162 of the bladder 108, a posterior lobe 182*c* disposed at the posterior end 164 of the bladder 108, and a pair of intermediate lobes 182*d*, 182*e* disposed in the intermediate region 166 of the bladder 108**.

The anterior lobes **182*a*, 182*b* of the peripheral chamber 172 include a lateral anterior lobe 182*a* disposed at the anterior end 162 on the lateral side 22 of the bladder 108, and a medial anterior lobe 182*b* disposed at the anterior end 162 on the medial side 24 of the bladder 108. As shown, the first ends 184*a*, 184*b* of the anterior lobes 182*a*, 182*b* are connected to each other at the longitudinal axis $A_{108}$ of the bladder 108. Each of the anterior lobes 182*a*, 182*b* extends from its respective first end 184***a*, 184*b* and around the anterior end 178 of the interior chamber 170 to its respective second end 186*a*, 186*b* in the intermediate region 166 of the bladder 108. In the illustrated example, the anterior lobes 182*a*, 182*b* provide the peripheral chamber 172 with an increased width $W_{172}$ at the lateral and medial sides of the anterior end 162 such that the anterior lobes 182*a*, 182*b* form a pair of forward-protruding portions at opposite sides of the anterior end 162 of the bladder 108.

With continued reference to FIGS. 11A-12, the posterior lobe 182*c* is disposed at the posterior end 164 of the bladder 108 and the intermediate portion 188*c* of the posterior lobe 182*c* is centrally positioned along the longitudinal axis $A_{108}$ of the bladder 108. In the illustrated example, the posterior lobe 182*c* extends around the posterior end 180 of the interior chamber 170 from a first end 184*a* on the lateral side 22 of the bladder 108 to a second end 186*c* on the medial side 24 of the bladder 108. As discussed above, the intermediate portion 188*c* has a greater cross-sectional area than each of the ends 184*c*, 186*c*.

The intermediate lobes 182*d*, 182*e* of the peripheral chamber 172 include a lateral intermediate lobe 182*d* disposed in the intermediate region 166 on the lateral side 22 of the bladder 108, and a medial intermediate lobe 182*e* disposed in the intermediate region 166 on the medial side 24 of the bladder 108. As shown, first ends 184*d*, 184*e* of the intermediate lobes 182*d*, 182*e* are connected to the second ends 186*a*, 186*b* of the lateral and medial anterior lobes 182*a*, 182*b*, respectively. The second end 186*d* of the lateral intermediate lobe 182*d* is connected to the first end 184*c* of the posterior lobe 182*c* at the posterior end 164 of the bladder 108. Likewise, the second end 186*e* of the medial intermediate lobe 182*e* is connected to the second end 186*c* of the posterior lobe 182*c* at the posterior end 164 of the bladder 108. Similar to the anterior lobes 182*a*, 182*b* at the anterior end 162 and the posterior lobe 182*c* at the posterior end 164, the intermediate lobes 182*d*, 182*e* provide the peripheral chamber 172 with protruding portions along the lateral and medial sides 22, 24 of the intermediate region 166 of the bladder 108.

As shown in FIG. 11B, the variable cross section of the peripheral chamber 172 results in the overall width $W_{108}$ of the bladder 108 being variable from the anterior end 162 to the posterior end 164. Particularly, the bladder 108 has a first width $W_{108\text{-}1}$ across the intermediate portions 188*a*, 188*b* of the anterior lobes 182*a*, 182*b* adjacent to the anterior end 162, a second width $W_{108\text{-}2}$ across the second ends 186*a*, 186*b* of the anterior lobes 182*a*, 182*b* in the intermediate region 166, and a third width $W_{108\text{-}3}$ across the intermediate portions 188*d*, 188*e* of the intermediate lobes 182*d*, 182*e* adjacent to the posterior end 164. Here, the second width $W_{108\text{-}2}$ is less than the first width $W_{108\text{-}1}$ and the third width $W_{108\text{-}3}$, while the third width $W_{108\text{-}3}$ is greater than the first width $W_{108\text{-}1}$ and the second width $W_{108\text{-}2}$.

Referring now to FIG. 6, the thickness $T_{108}$ the bladder 108 generally increases along a direction from the anterior end 162 to the posterior end 164. However, as discussed above, because the peripheral chamber 172 is formed with a variable cross section, the change in thickness $T_{108}$ is not constant and continuous along the length of the bladder 108. Instead, the thickness of the bladder 108 incrementally increases along the length $L_{108}$ of the bladder 108. For example, the bladder 108 has a first thickness $T_{108}$ at the anterior end 162 defined by the intermediate portions 188*a*, 188*b* of the anterior lobes 182*a*, 182*b* and a second thickness $T_{108}$ at the posterior end 164 defined by the intermediate portion 188*c* of the posterior lobe 182*c*. Here, the second thickness $T_{108}$ is greater than the first thickness $T_{108}$ such that an average thickness of the bladder 108 increases from the anterior end 162 to the posterior end 164. Furthermore, as shown in the cross-sectional view of FIG. 6, the thickness of the bladder 108 also incrementally increases along the longitudinal axis $A_{108}$. Accordingly, the bladder 108 has a thickness $T_{108}$ at the first ends 184*a*, 184*b* of the anterior lobes 182*a*, 182*b* that is less than the thickness $T_{108}$ at the interior chamber 170, which is, in turn, less than the thickness $T_{108}$ at the posterior lobe 182*c*.

The chambers 170, 172 can be provided in a fluid-filled (e.g., as provided in footwear 10) or in an unfilled state. The chambers 170, 172 can be filled to include any suitable fluid, such as a gas or liquid. In an aspect, the gas can include air, nitrogen ($N_2$), or any other suitable gas. The fluid provided to the chambers 170, 172 can result in the bladder 108 being pressurized. Alternatively, the fluid provided to the chambers 170, 172 can be at atmospheric pressure such that the chambers 170, 172 are not pressurized but, rather, simply contain a volume of fluid at atmospheric pressure. In other aspects, the chambers 170, 172 can alternatively include other compressible media, such as pellets, beads, ground recycled material, and the like (e.g., foamed beads and/or rubber beads).

In the illustrated example, the interior void of the interior chamber 170 includes a first fluid at a first pressure and the interior void of the peripheral chamber 172 includes a second fluid at a second pressure. As discussed above, the interior chamber 170 is isolated from the peripheral chamber 172 such that the first pressure and the second pressure may be independently maintained within the interior voids. The first pressure and the second pressure may be different from each other. For instance, the first pressure within the interior void of the interior chamber 170 may be less than the second pressure within the interior void of the peripheral chamber 172 when the bladder 108 is in an uncompressed (i.e., natural) state. In some examples, the first pressure ranges from 0 psi to 20 psi, and more particularly from 5 psi to 15 psi, and even more particularly from 7 psi to 10 psi. The second pressure may range from 0 psi to 35 psi, and more particularly from 15 psi to 30 psi, and even more particularly from 20 psi to 25 psi.

Providing the bladder 108 with an interior chamber 170 having a lower pressure than the surrounding peripheral chamber 172 allows the interior chamber 170 to provide a softer cushioning response to a point load applied by the central portion of the heel when sole structure 100 contacts a ground surface. Upon initial compression of the interior chamber 170, the higher pressure of the peripheral chamber 172 provides secondary cushioning around a perimeter of the heel. Furthermore, the higher pressure of the peripheral chamber 172 provides the heel region with enhanced lateral (i.e., side-to-side, front-to-back) stability. Thus, the dual-chamber configuration of the bladder 108 advantageously provides both impact attenuation and stability.

With reference to FIGS. 1-8, when the sole structure 100 is assembled, the bladder 108 is received within the cavity 156 such that each of the chambers 170, 172 is disposed between opposing support surfaces 160*a*-1601 of the upper and lower supports 158*a*-1581. Particularly, the peripheral chamber 172 is supported between the upper peripheral pillars 158*a*-158*e* and the lower peripheral pillars 158*f*-158*j*, and the interior chamber 170 is supported between the upper interior pillar 158*k* and the lower interior pillar 158*l*. Accordingly, the interior chamber 170 is engaged by the resilient materials of the cushioning element 110 and the outsole 104, while the peripheral chamber 172 is engaged by the more rigid materials of the cradle 112.

In the illustrated example, the peripheral pillars 158*a*-158*j* are arranged to engage respective ones of the lobes 182*a*-182*e* of the peripheral chamber 172. For example, as best shown in FIGS. 3 and 4, the lateral anterior lobe 182*a* (FIG. 4) is interposed between the first upper peripheral pillar 158*a* and the first lower peripheral pillar 158*f*, while the medial anterior lobe 182*b* (FIG. 3) is interposed between the second upper peripheral pillar 158*b* and the second lower peripheral pillar 158*g*. As best shown in FIG. 6, the posterior lobe 182*c* is interposed between the fifth upper peripheral pillar 158*e* and the fifth lower peripheral pillar 158*j*. Referring to FIG. 7, the lateral intermediate lobe 182*d* is interposed between the third upper peripheral pillar 158*c* and the third lower peripheral pillar 158*h*, and the medial intermediate lobe 182*e* is interposed between the fourth upper peripheral pillar 158*d* and the fourth lower peripheral pillar 158*i*.

By supporting the peripheral chamber 172 in the foregoing manner, the thickest portions of the peripheral chamber 172 (i.e., the intermediate portions 188*a*-188*e* of the lobes 182*a*-182*e*) are discretely supported between the protruding support surfaces 160*a*-160*k* of the pillars 158*a*-158*k* within the cavity 156. However, as shown, portions of the peripheral chamber 172 between the intermediate portions 188*a*-188*e* are spaced inwardly from the upper and lower rails 136*a*, 136*b* and the outer periphery of the peripheral chamber 172 is also exposed. Accordingly, when the lobes 182*a*-182*e* are compressed by the pillars 158*a*-158*k*, the pressure within the peripheral chamber 172 will increase and may cause the peripheral chamber 172 to deform in the narrower portions and/or along the outer periphery. Allowing the peripheral chamber 172 to deform under the point loads of the pillars 158*a*-158*k* provides progressive responsiveness as the fluid within the peripheral chamber 172 is redistributed and the barrier layers 168 react.

The upper 200 is attached to the sole structure 100 and includes interior surfaces that define an interior void configured to receive and secure a foot for support on sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

With particular reference to FIGS. 15-27, an article of footwear 10*a* is provided and includes a sole structure 100*a* and an upper 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

Figure 15:
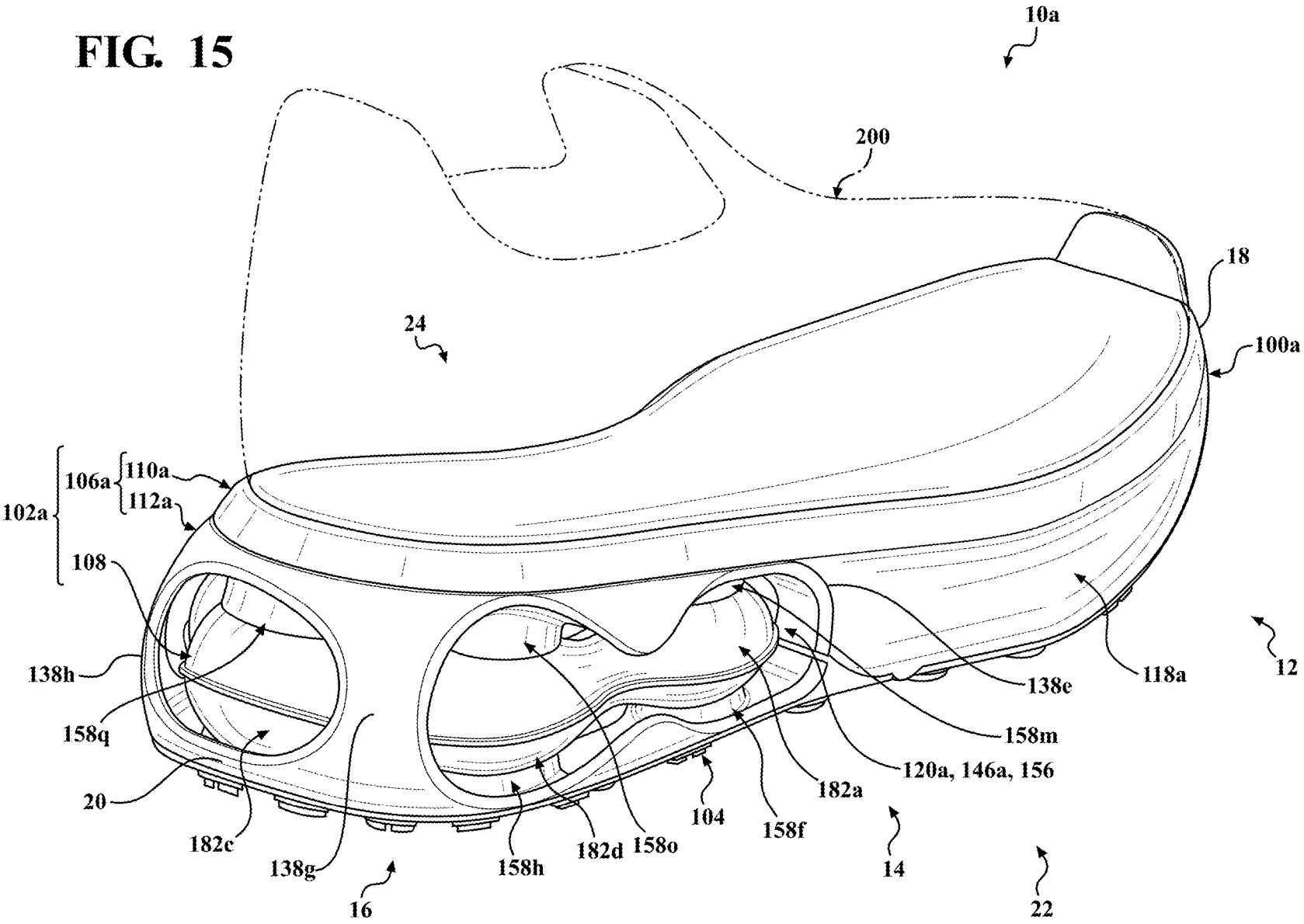
FIG. 15 is a side perspective view of a sole structure for an article of footwear in accordance with principles of the present disclosure.
Figure 16A:
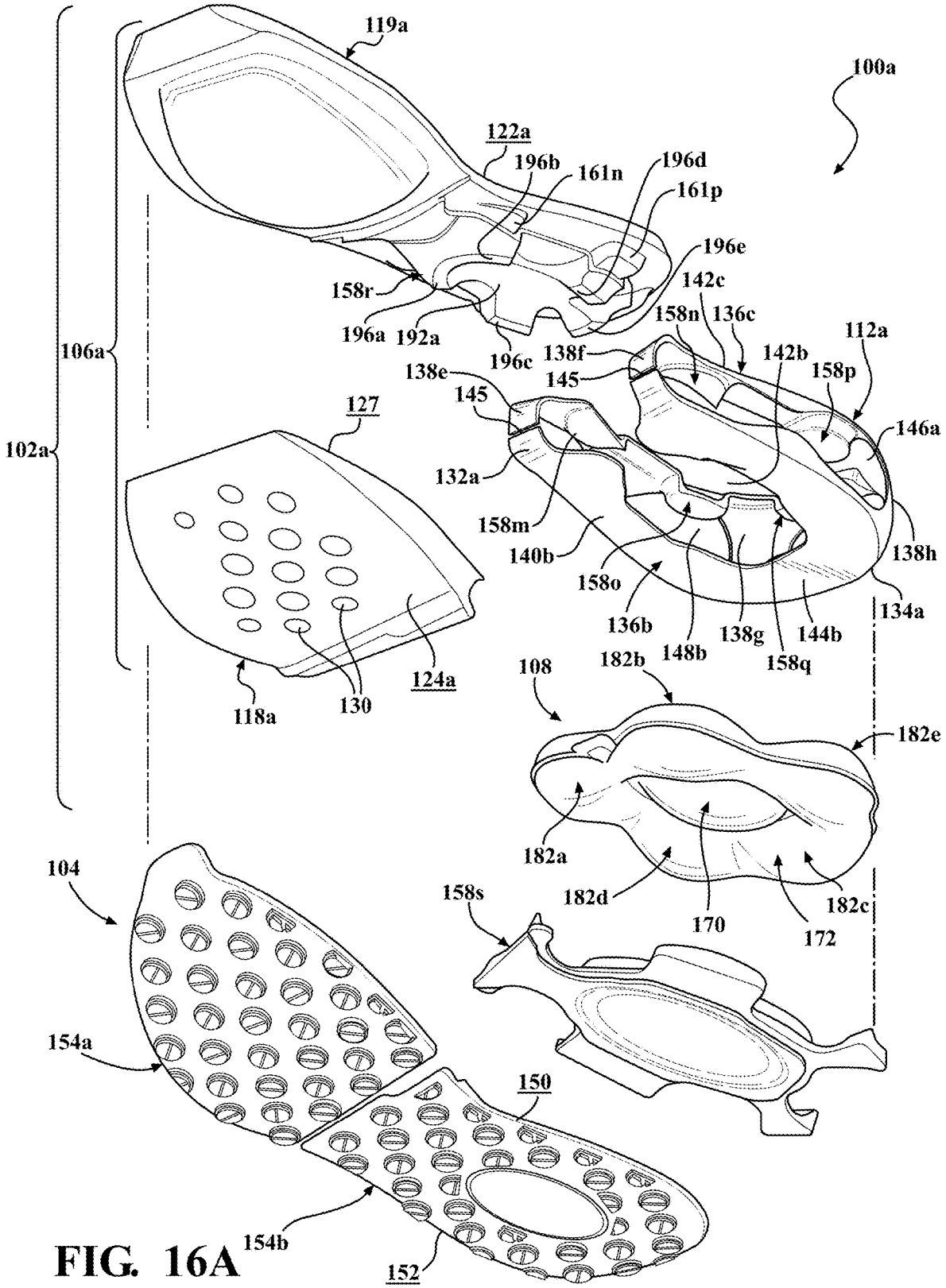
FIG. 16A is an exploded bottom perspective view of the sole structure of FIG. 15.
Figure 16B:
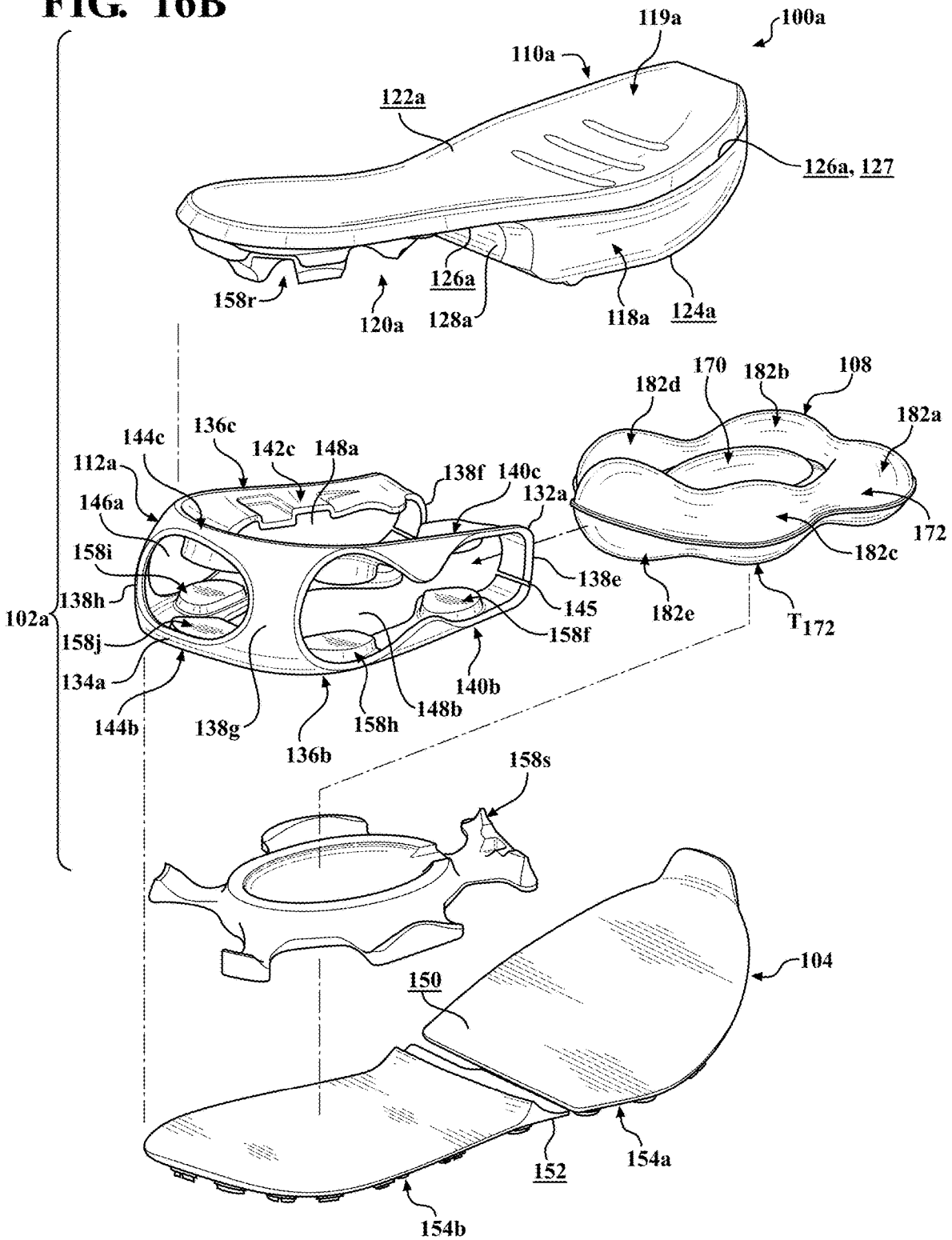
FIG. 16B is an exploded top perspective view of the sole structure of FIG. 15.

With reference to FIGS. 15-16B, the sole structure 100*a* includes a midsole 102*a* configured to provide cushioning characteristics to the sole structure 100*a*, and an outsole 104 configured to provide a ground-engaging surface of the article of footwear 10*a*. Unlike conventional sole structures, the midsole 102*a* of the sole structure 100*a* may be formed compositely and include a plurality of subcomponents for providing desired forms of cushioning and support throughout the sole structure 100*a*. For example, the midsole 102*a* includes a chassis 106*a* and the bladder 108, where the chassis 106*a* is configured to be attached to the upper 200 and provides an interface between the upper 200, the bladder 108, and the outsole 104.

In the illustrated example, the chassis 106*a* extends continuously from the anterior end 18 to the posterior end 20, and is configured to receive and support the bladder 108 therein. In some examples, the chassis 106*a* is formed as a composite structure including a cushioning element 110*a* and a cradle 112*a* received at least partially within the cushioning element 110*a*. While the cushioning element 110*a* and the cradle 112*a* of the illustrated example are shown as separate components that cooperate to form the chassis 106*a*, in some examples, the chassis 106*a* may be formed as a unitary body.

The cushioning element 110*a* includes a resilient first material, and extends continuously from a first end 114 at the anterior end 18 to a second end 116 at the posterior end 20. As shown, the cushioning element 110*a* may be generally described as including a forefoot support member 118*a* configured to provide a first region of cushioning to the chassis 106*a*, and a recess 120*a* configured to receive and interface with the bladder 108 for providing a second region of cushioning to the chassis 106*a*. In the illustrated example, the cushioning element 110*a* includes a top surface 122*a* of the chassis 106*a* that defines a footbed of the sole structure 100*a* extending continuously from the anterior end 18 to the posterior end 20. A bottom surface 124*a* of the cushioning element 110*a* is formed on an opposite side of the cushioning element 110*a* from the top surface 122*a*, and extends from the anterior end 18 of the sole structure 100*a*. Here, the bottom surface 124*a* of the cushioning element 110*a* extends along a first portion of the sole structure 100*a* in the forefoot region 16, and terminates in the mid-foot region 14.

In the illustrated example, the recess 120*a* is formed in the heel region 16 of the cushioning element 110*a* and is configured to receive the cradle 112*a* and the bladder 108 therein. Here, the recess 120*a* extends through each of the bottom surface 124*a* and the second end 116 of the cushioning element 110*a*, such that the recess 120*a* provides the cushioning element 110*a* with a stepped profile. However, in other examples, the recess 120*a* may be contained at least partially within the cushioning element 110*a*. For instance, the recess 120*a* may be formed between the top surface 122*a* and the bottom surface 124*a* and/or between the first end 114 and the second end 116.

In the illustrated example, the cushioning element 110*a* is formed as a composite structure, whereby the forefoot support member 118*a* is formed as a separate component and depends from an upper portion of the cushioning element 110*a*. Specifically, the cushioning element 110*a* may be described as including an upper footbed portion 119*a* extending from the first end 114 to the second end 116. The footbed portion 119*a* includes the top surface 122*a* and a lower surface 126*a* formed on an opposite side of the footbed portion 119*a* than the top surface 122*a*. The forefoot support member 118*a* includes the bottom surface 124*a* and an upper surface 127 formed on an opposite side. When the cushioning element 110*a* is assembled, the upper surface 127 of the forefoot support member 118*a* faces and is attached to the lower surface 126*a* of the upper footbed portion 119*a* of the cushioning element 110*a*. In some examples, the upper surface 127 of the forefoot support member 118*a* may form a depression or recess for receiving a corresponding protrusion formed on the lower surface 126*a* of the upper footbed portion 119*a*. As shown, the forefoot support member 118*a* further includes an end wall 128*a* extending from the bottom surface 124*a* to the upper surface 127.

With reference to FIG. 16B, the recess 120*a* of the illustrated example is defined by the lower surface 126*a* of the footbed portion 119*a* and the end wall 128*a* of the forefoot support member 118*a*. As provided above, the lower surface 126*a* is formed on an opposite side (i.e., faces away) from the top surface 122*a* of the cushioning element 110*a*, and is offset from the bottom surface 124*a* by a distance corresponding to a height of the cradle 112*a*. Accordingly, when the cradle 112*a* is received within the recess 120*a*, a bottom portion of the cradle 112*a* is flush with the bottom surface 124*a* of the forefoot support member 118*a* to define a bottom support surface of the chassis 106*a*, as discussed in greater detail below. The end wall 128*a* extends between the lower surface 126*a* of the footbed portion 119*a* and the bottom surface 124*a* forefoot support member 118*a*, and forms an anterior end of the recess 120*a* in the mid-foot region 14.

The cushioning element 110*a* may further include one or more apertures 130 formed in the bottom surface 124*a* of the forefoot support member 118. In the illustrated example, the apertures 130 are formed in the forefoot region 12 to provide a modified compressibility to the cushioning element 110*a*. For instance, where the bladder 108 provides the heel region 16 of the sole structure 100*a* with a relatively soft feel, the apertures 130 may be formed through the forefoot region 12 of the cushioning element 110*a* to provide a comparable feel in the forefoot region 12.

As described above, the cushioning element 110*a* includes one or more resilient polymeric materials, such as foam or rubber, to impart properties of cushioning, responsiveness, and energy distribution to the foot of the wearer. For example, the forefoot support member 118*a* may include a different cushioning material than the footbed portion 119*a*. Example resilient polymeric materials for the cushioning element 110*a* may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

With continued reference to FIGS. 15-16B, the cradle 112*a* is received within the recess 120*a* of the cushioning element 110*a*, and cooperates with the cushioning element 110*a* and the outsole 104 to support the bladder 108. In the illustrated example, the cradle 112*a* extends from a first end 132*a* to a second end 134*a*. When the sole structure 100*a* is assembled, the first end 132*a* of the cradle 112*a* is disposed adjacent to and faces the end wall 128*a* of the recess 120*a*, while the second end 134*a* is aligned with the second end 116 of the cushioning element 110*a* at the posterior end 20 of the sole structure 100*a*. However, as discussed above, in examples where the recess 120*a* is disposed within the cushioning element 110*a*, such as between the first end 114 and the second end 116, the cradle 112*a* will also be disposed within the cushioning element 110*a*.

Figure 24:
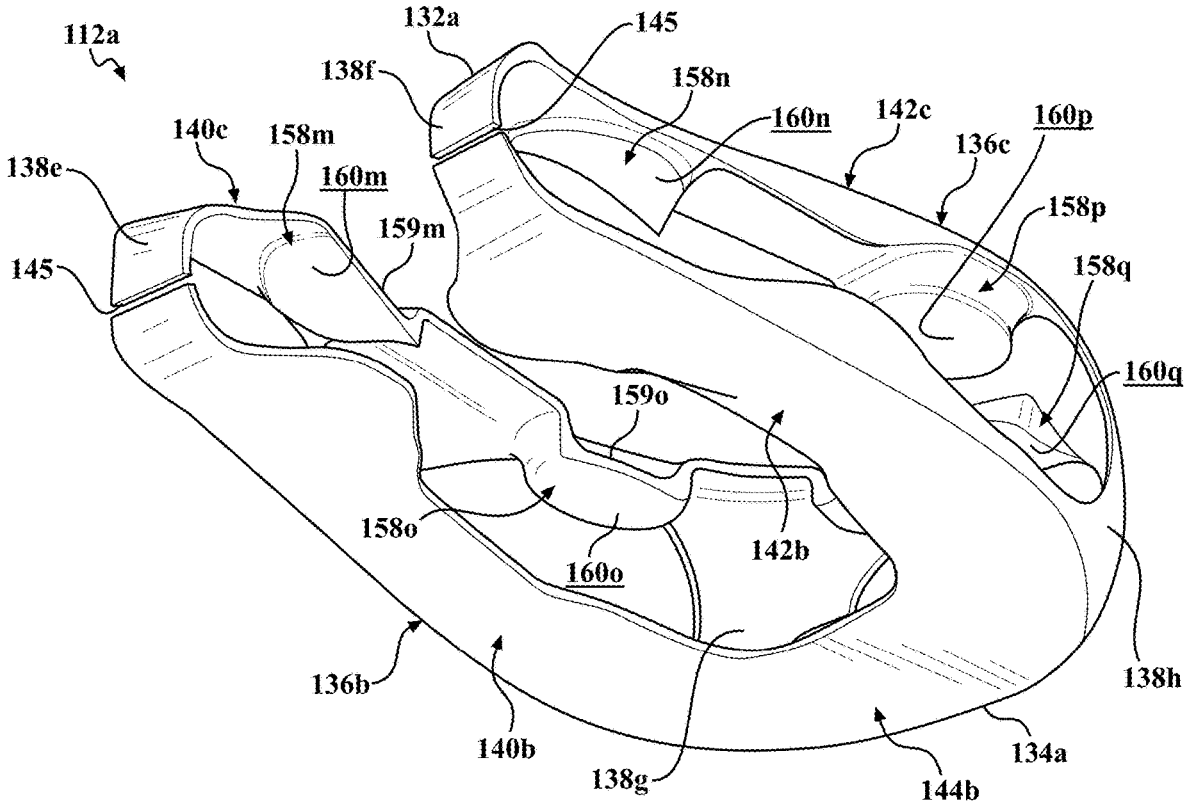
FIG. 24 is a bottom perspective view of a cradle for a sole structure in accordance with principles of the present disclosure.
Figure 25:
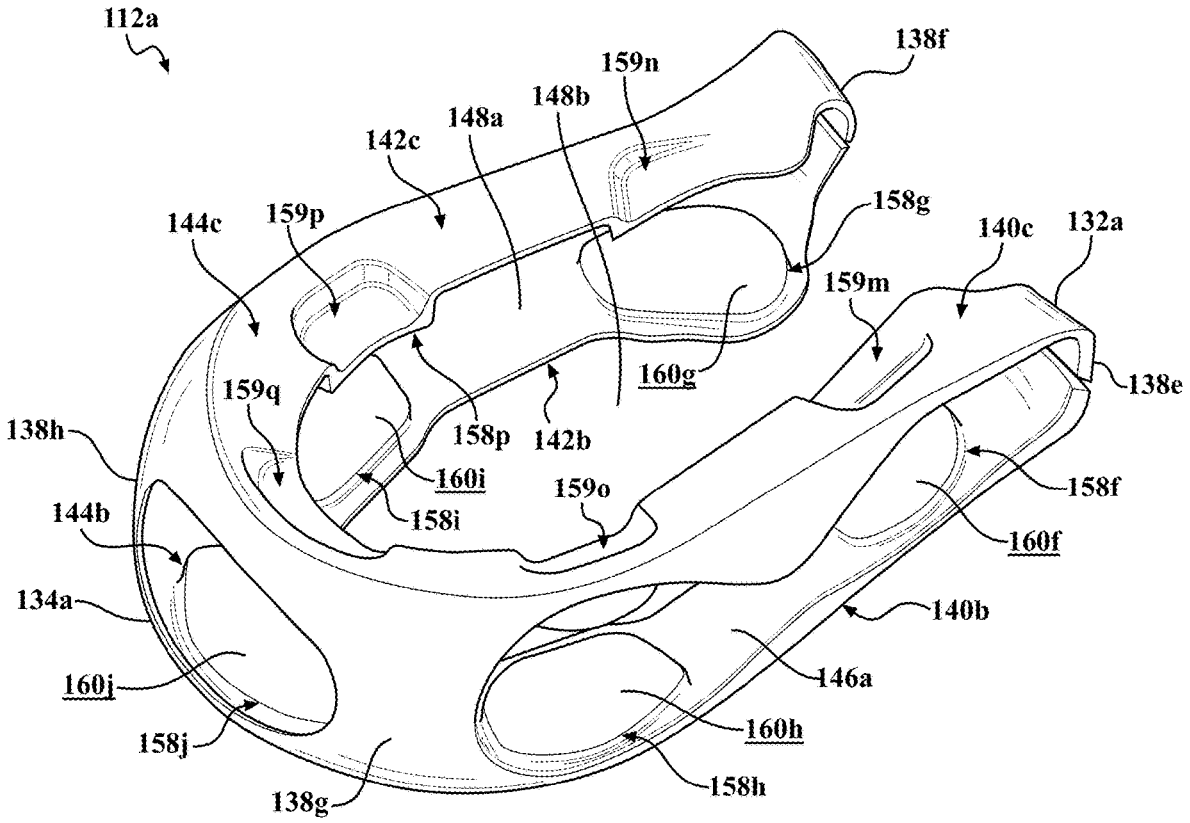
FIG. 25 is a top perspective view of a cradle for a sole structure in accordance with principles of the present disclosure.

As best shown in FIGS. 24 and 25, the cradle 112*a* includes a pair of substantially parallel (i.e., not intersecting) rails 136*b*, 136*c* vertically spaced apart from and connected to each other by one or more braces 138*e*-138*h*. In the illustrated example, the rails 136*b*, 136*c* include an upper rail 136*c* forming an upper portion of the cradle 112*a* and the lower rail 136*b* forming a lower portion of the cradle 112*a*. Each of the lower rail 136*b* and the upper rail 136*c* extends along a U-shaped path and includes an elongate lateral segment 140*b*, 140*c*, an elongate medial segment 142*b*, 142*c* laterally spaced apart from and parallel to the respective lateral segment 140*b*, 140*c*, and a connecting segment 144*b*, 144*c* extending between and connecting the respective lateral segments 140*b*, 140*c* and medial segments 142*b*, 142*c*. Accordingly, the lower segments 140*b*, 142*b*, 144*b* cooperate to form the lower rail 136*b*, and the upper segments 140*c*, 142*c*, 144*c* cooperate to form the upper rail 136*c*.

In the illustrated example, the upper rail 136*c* is spaced apart from and connected to the lower rail 136*b* by a plurality of the braces 138*e*-138*h*. Particularly, a first brace 138*e* extends between and connects respective ends of the lateral segments 140*b*, 140*c* on a first side of the cradle 112*a* at the first end 132*a*. Similarly, a second brace 138*f* extends between and connects respective ends of the medial segments 142*b*, 142*c* on a second side of the cradle 112*a* at the first end 132*a*. The cradle 112*a* further includes a third brace 138*g* and a fourth brace 138*h* connecting the upper rail 136*c* to the lower rail 136*b* at the second end 134*a* of the cradle 112*a*. Here, the third brace 138*g* extends from a first end attached to the upper rail 136*c* between the lateral segment 140*c* and the connecting segment 144*c* of the upper rail 136*c*, to a second end attached to the lower rail 136*b* between the lateral segment 140*b* and the connecting segment 144*b* of the lower rail 136*b*. Similarly, the fourth brace 138*h* extends from a first end attached to the upper rail 136*c* between the medial segment 142*c* and the connecting segment 144*c* of the upper rail 136*c*, to a second end attached to the lower rail 136*b* between the medial segment 142*b* and the connecting segment 144*b* of the lower rail 136*b*.

Optionally, one or more of the braces 138*e*-138*h* may include a separation or split 145 to allow an upper portion of the brace 138*e*-138*f* to be pulled apart from a lower portion of the brace 138*e*-138*f*. For instance, in the illustrated example, the first brace 138*e* and the second brace 138*f* each include a split 145. Here, the splits 145 formed through the braces 138*e*, 138*f* at the first end 132*a* of the cradle 112*a* allow the upper rail 136*c* and the lower rail 136*b* to be pulled apart from each other at the first end 132*a* of the cradle 112*a*, where the third and fourth braces 138*g*, 138*h* act as living hinges at the second end 134*a* of the cradle 112*a*. This configuration allows the cradle 112*a* to be opened from the first end 132*a* so that the bladder 108 can be more easily inserted into the cradle 112*a*.

As shown, the rails 136*b*, 136*c* and the braces 138*e*-138*h* cooperate to define avoid 146*a* of the cradle 112*a* for receiving at least a portion of the bladder 108 therein. Particularly, the void 146*a* is formed between the lower and upper rails 136*b*, 136*c* and is surrounded by the braces 138*e*-138*h*. The cradle 112*a* may further include the lower and upper openings 148*b*, 148*a*, which are respectively defined by the rails 136*b*, 136*c*. Particularly, the cradle 112*a* includes an upper opening 148*a* formed in the interior region 28 and surrounded by the upper rail 136*c*, and a lower opening 148*b* formed in the interior region 28 and surrounded by the lower rail 136*b*. Because the rails 136*b*, 136*c* are U-shaped, the openings 148*b*, 148*a* extend continuously through the first end 132*a* of the cradle 112*a*. However, in some examples, the lateral segments 140*b*, 140*c* may be connected to the medial segments 142*b*, 142*c* at the first end 132*a*, such that the openings 148*a*, 148*b* are completely surrounded by the rails 136*b*, 136*c*.

In examples where the chassis 106*a* is formed as a composite structure including the cushioning element 110*a* and the cradle 112*a*, the cushioning element 110*a* and the cradle 112*a* may be formed of materials having different properties. For example, the cushioning element 110*a* may include first materials configured to provide desired levels of cushioning and impact attenuation, while the cradle 112*a* includes one or more materials configured to impart a greater degree of stiffness to the heel region 16 of the chassis 106*a*. In some examples, the cushioning element 110*a* may be formed of or include a resilient and compressible first material, discussed above, and the cradle 112*a* may include or be formed of a second material having a greater stiffness and/or hardness than the first material.

With continued reference to FIGS. 16A and 16B, the outsole 104 is configured to be attached to the midsole 102*a* to provide a durable ground-engaging surface to the sole structure 100*a*. The outsole 104 includes an inner surface 150 that attaches to the forefoot support member 118*a* and the cradle 112*a*, and an exterior surface 152 formed on an opposite side of the outsole 104 than the inner surface 150. The outsole 104 may be described as including a first portion 154*a* attached to the bottom surface 124*a* of the cushioning element 110*a* along the forefoot support member 118*a*, and a second portion 154*b* attached to the lower rail 136*b* of the cradle 112*a*. As shown, the outsole 104 is formed as a unitary structure such that the first portion 154*a* and the second portion 154*b* are attached to each other and effectively connect the bladder 108, the forefoot support member 118*a* of the cushioning element 110*a*, and the lower rail 136*b* of the cradle 112*a*. Furthermore, the second portion 154*b* of the outsole 104 may be described as enclosing a bottom side of the recess 120*a* of the cushioning element 110*a* to define a cavity 156 of the sole structure 100*a*.

In the illustrated example, the sole structure 100*a* includes a plurality of supports 158*f*-158*j*, 158*m*-158*s* disposed within the cavity 156 for supporting the bladder 108. The supports 158*f*-158*j*, 158*m*-158*s* may be formed as independent components of the sole structure 100*a*, or as integral parts of the cushioning element 110*a*, the cradle 112*a*, and/or the outsole 104. As discussed in greater detail below, each of the supports 158*f*-158*j*, 158*m*-158*s* protrudes into the cavity 156 from the sole structure 100*a*, and includes a distal end or support surface 160*f*-160*j*, 160*m*-160*s* configured to interface with the bladder 108. Accordingly, when the sole structure 100*a* is assembled, the supports 158*f*-158*j*, 158*m*-158*s* contact the bladder 108 at discrete locations within the cavity 156, thereby allowing the bladder 108 to freely expand within the cavity 156 in areas between the supports 158*f*-158*j*, 158*m*-158*s*. In this example, the supports 158*f*-158*j*, 158*m*-158*s* of the sole structure 100*a* may include a first plurality of the pillars 158*f*-158*j*, 158*m*-158*q* configured to support the peripheral chamber 172 of the bladder 108 in the peripheral region 26, and one or more sockets 158*r*, 158*s* configured to support the bladder 108 in the interior region 28.

In some examples, the support surfaces 160*f*-160*j*, 160*m*-160*q* of the peripheral pillars 158*f*-158*j*, 158*m*-158*q* are formed by the cradle 112*a*. Thus, the support surfaces 160*f*-160*j*, 160*m*-160*q* of the peripheral pillars 158*f*-158*j*, 158*m*-158*q* may be formed of the harder material of the cradle 112*a*, while the support surfaces 160*r*, 160*s* of the sockets 158*r*, 158*s* include more resilient or compressible materials. When the sole structure 100*a* is assembled, the rigid peripheral pillars 158*f*-158*j*, 158*m*-158*q* interface with the lobes 182*a*-182*e* of the peripheral chamber 172 of the bladder 108 and the resilient sockets 158*r*, 158*s* interface with the interior chamber 170 and the web area 174 of the bladder 108. As discussed previously, the first portion of the bladder 108 may be fluidly isolated from the second portion of the bladder 108, and may have a different pressure than the second portion of the bladder 108 such that the bladder 108 provides different characteristics in the peripheral region 26 than in the interior region 28.

As shown in FIGS. 15-18, the sole structure 100*a* includes a first plurality of upper peripheral pillars 158*m*-158*q* protruding in direction away from the lower surface 126*a* of the recess 120*a*. Thus, the upper support surfaces 160*m*-160*q* of the upper supports 158*m*-158*q* face away from the lower surface 126*a* of the cushioning element 110*a*. The sole structure 100*a* further includes the lower peripheral pillars 158*f*-158*j* disposed on an opposite side of the cavity 156 and protruding towards the lower surface 126*a* of the recess 120*a*. Accordingly, lower support surfaces 160*f*-160*j* of the lower pillars 158*f*-158*j* face towards upper support surfaces 160*m*-160*q* of the upper peripheral pillars 158*m*-158*q*.

As best shown in FIGS. 24 and 25, the cradle 112*a* includes the upper peripheral pillars 158*m*-158*q* formed along an inner surface of the upper rail 136*c*. The upper peripheral pillars 158*m*-158*q* are arranged along the upper rail 136*c* in the same manner as the upper peripheral pillars 158*m*-158*q* discussed above. However, unlike the upper peripheral pillars 158*m*-158*q* discussed above, which are formed as solid bodies protruding from the upper rail 136*c*, the upper peripheral pillars 158*m*-158*q* of the current example are formed as composite structures including the material of the cushioning element 110*a* and the material of the cradle 112*a*. Particularly, each of the upper peripheral pillars 158*m*-158*q* includes a hollow shell 159*m*-159*q* formed by the cradle 112*a*, which defines the upper support surface 160*m*-160*q*. The shell 159*m*-159*q* also defines a hollow cavity in the upper surface of the upper rail 136*c*, which receives a resilient core 161*m*-161*q*. In the illustrated example, the resilient core 161*m*-161*q* of each pillar 158*m*-158*q* is formed as an integral projection from the lower surface 126*a* of the cushioning element 110*a*.

Referring still to FIGS. 24 and 25, the cradle 112*a* includes the lower peripheral pillars 158*f*-158*j* formed along an inner surface of the lower rail 136*b*. Generally, the lower peripheral pillars 158*f*-158*j* are aligned across the void 146*a* with corresponding ones of the upper peripheral pillars 158*m*-158*q*. In other words, the upper support surfaces 160*m*-160*q* directly face or oppose the lower support surfaces 160*f*-160*j* so that the bladder 108 is interposed therebetween.

Figure 21:
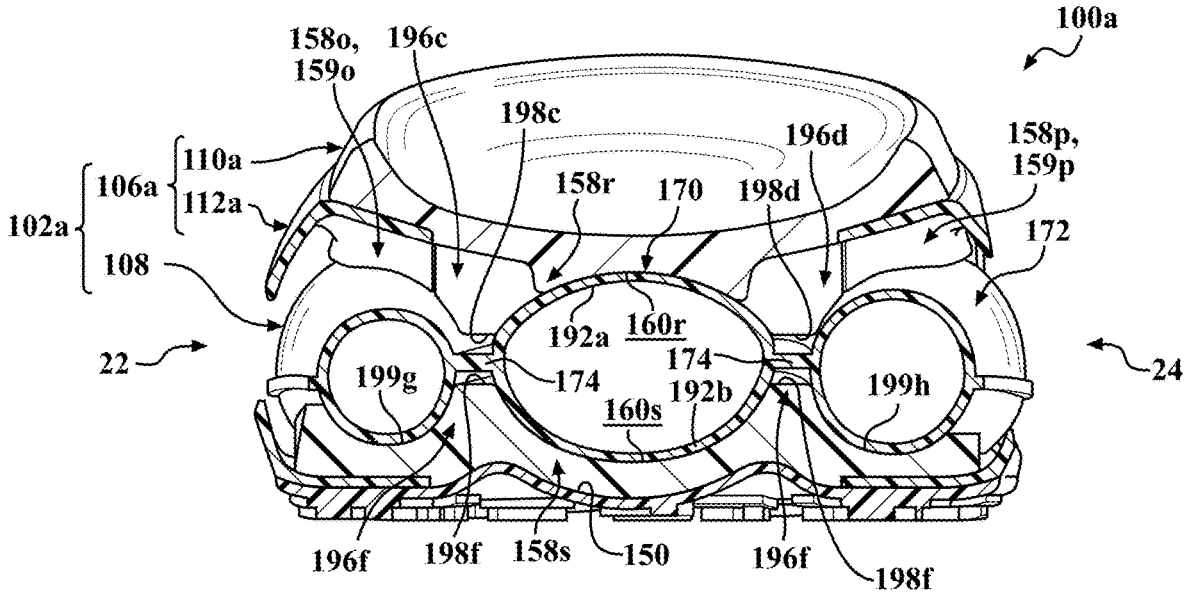
FIG. 21 is a cross-sectional view of the sole structure of FIG. 15, taken along Line 21-21 of FIG. 19.
Figure 22:
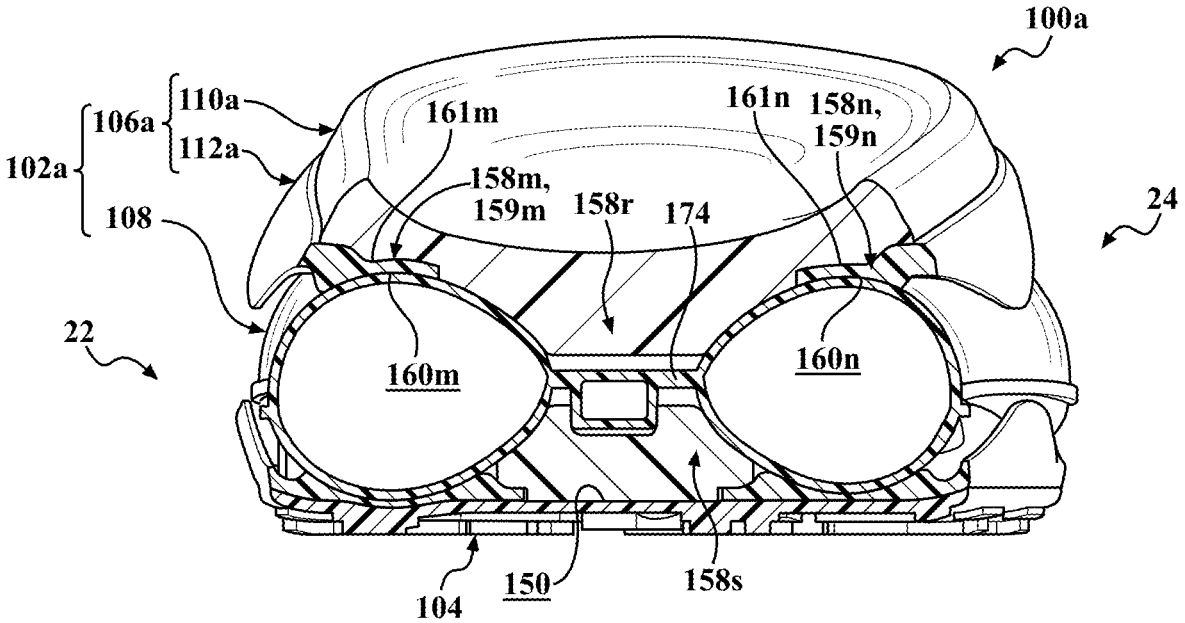
FIG. 22 is a cross-sectional view of the sole structure of FIG. 15, taken along Line 22-22 of FIG. 19.
Figure 23:
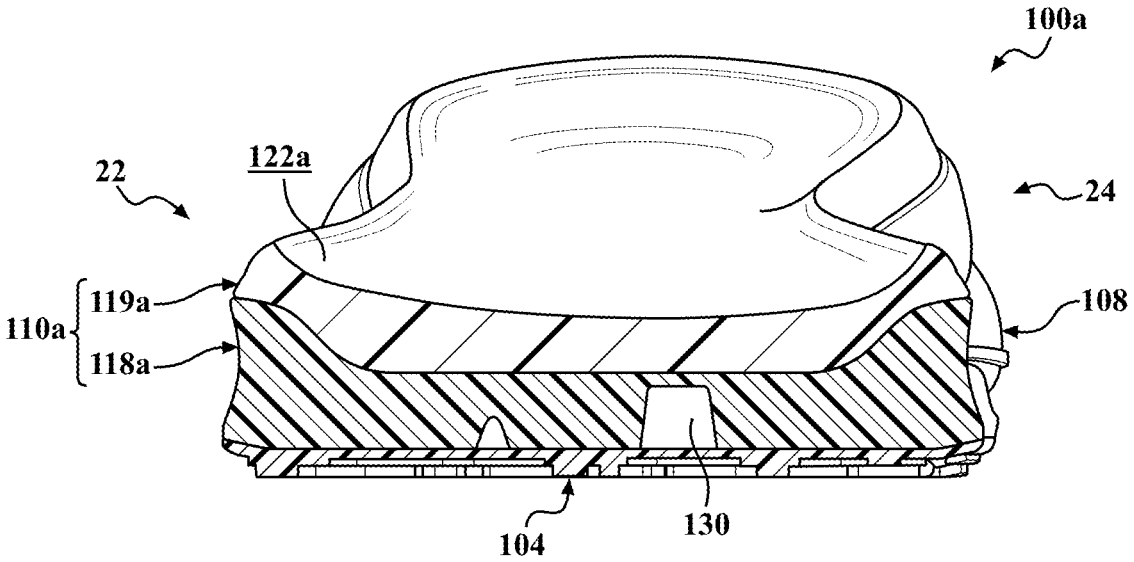
FIG. 23 is a cross-sectional view of the sole structure of FIG. 15, taken along Line 23-23 of FIG. 19.

As best shown in the cross-sections of FIGS. 21 and 22, the sockets 158*r*, 158*s* extend through the openings 148*a*, 148*b* in the cradle 112*a* to interface with an interior portion of the bladder 108 when the sole structure 100*a* is assembled. The upper socket 158*r* is formed as part of the cushioning element 110*a* and protrudes into the cavity 156 from the lower surface 126*a* of cushioning element 110*a*, while the lower socket 158*s* is formed as an independent component attached to the inner surface 150 of the outsole 104. The upper socket 158*r* and the lower socket 158*s* may include the same or different resilient polymeric material.

With particular reference to FIGS. 16A, 21, 22, and 26, the upper socket 158*r* includes an interior receptacle 192*a* configured to receive the upper portion of the interior chamber 170 of the bladder 108, and plurality of fingers 194*a*-194*e* extending outwardly from the interior receptacle 192*a* and configured to interface with the web area 174 and the peripheral chamber 172. As shown, the arrangement of the fingers 194*a*-194*e* around the interior receptacle 192*a* corresponds to the arrangement of the lobes 182*a*-182*e* of the bladder 108 such that each of the fingers 194*a*-194*e* is radially aligned with one of the lobes 182*a*-182*e*.

Figure 26:
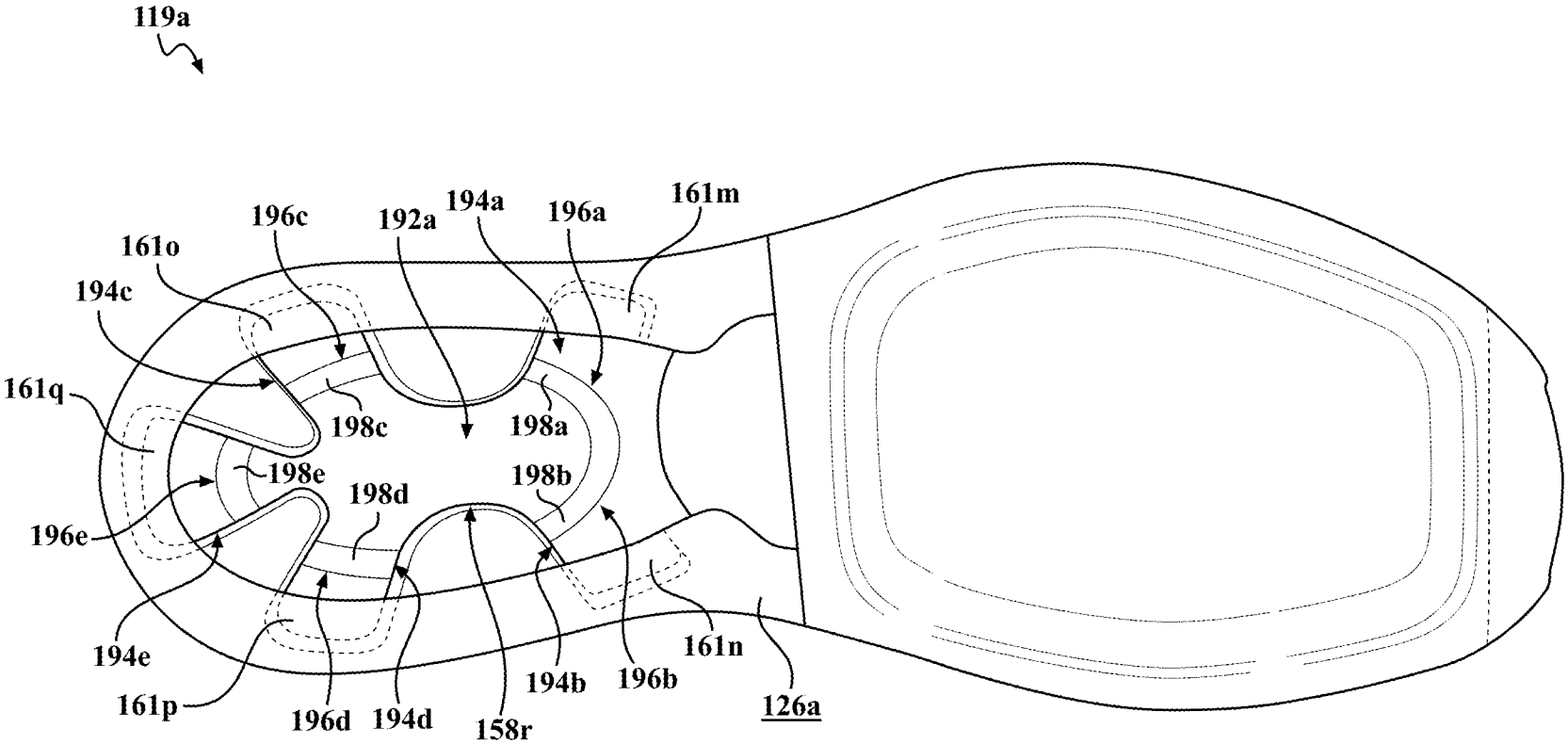
FIG. 26 is a bottom plan view of a cushioning element of the sole structure of FIG. 15.
Figure 27:
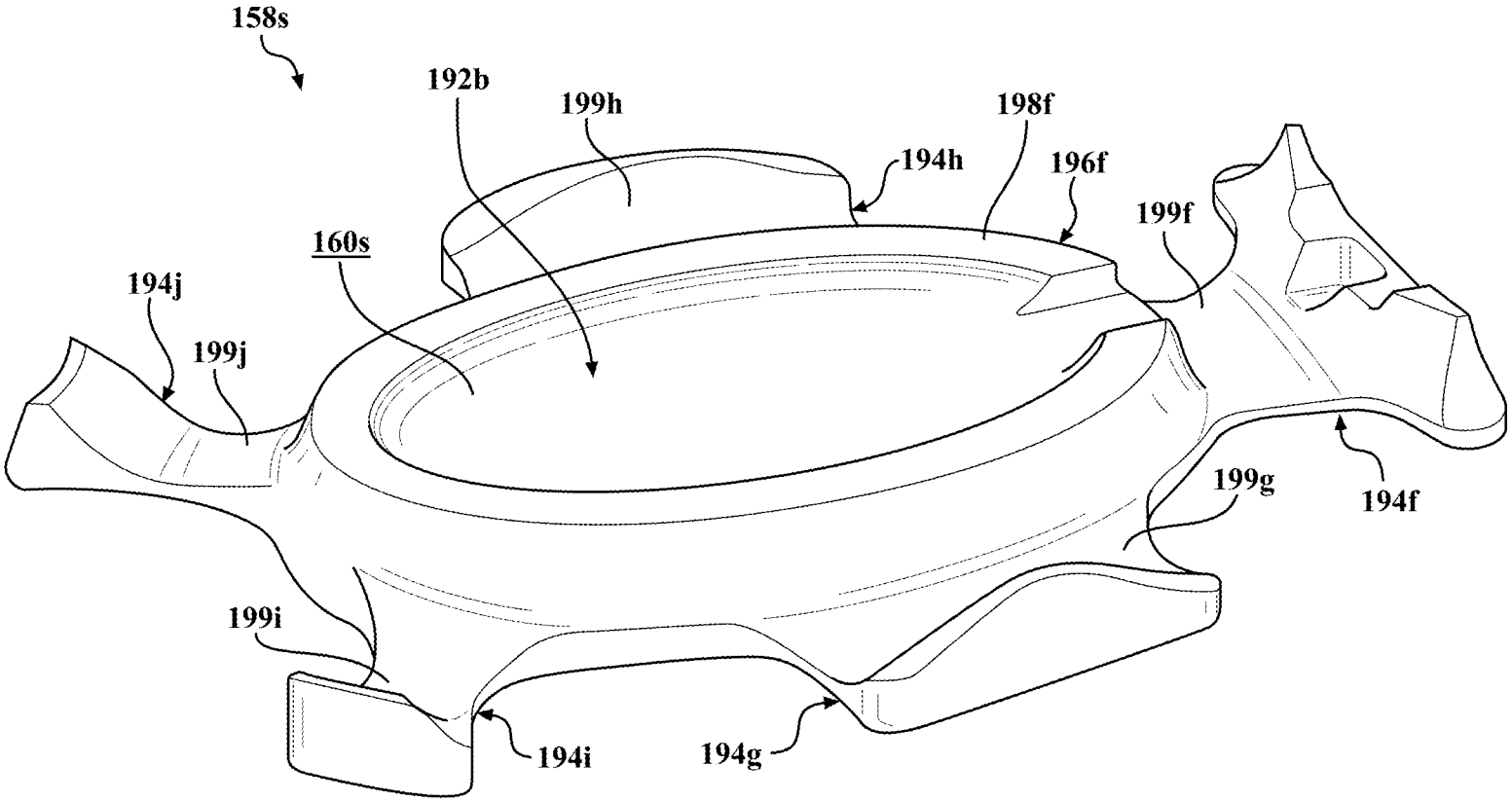
FIG. 27 is a top perspective view of a socket of the sole structure of FIG. 15.

Each of the fingers 194*a*-194*e* includes a rib 196*a*-196*e* extending in a direction away from the lower surface 126*a* to a distal end 198*a*-198*e* that opposes the upper barrier layer 168 at the web area 174. As shown in FIG. 26, the upper ribs 196*a*-196*e* are spaced apart from each other around the periphery of the interior receptacle 192*a* such that the upper ribs 196*a*-196*e* provide discrete interface points with the upper barrier layer 168 along the web area 174. Referring to FIG. 21, the distal ends 198*a*-198*e* of the upper ribs 196*a*-196*e* may be separated from the upper barrier layer 168 in the web area 174 by a gap such that the distal ends 198*a*-198*e* only contact the web area 174 when the soles structure 100*a* is compressed.

Distal end portions (i.e., radially outwardly of the ribs 196*a*-196*e*) of the fingers 194*a*-194*e* may be received within the shell 159*m*-159*q* of the upper peripheral pillars 158*m*-158*q* to form the cores 161*m*-161*q* of the upper peripheral pillars 158*m*-158*q*. In some instances, the outer portions of the fingers 194*a*-194*e* may cooperate with the shells 159*m*-159*q* of the cradle 112*a* and define a portion of the upper support surfaces 160*m*-160*q* in direct contact with the upper barrier layer 168.

Referring now to FIGS. 16A, 21, 22, and 27, the lower socket 158*s* includes an interior receptacle 192*b* configured to receive the lower portion of the interior chamber 170 of the bladder 108, and a plurality of fingers 194*f*-194*j* extending outwardly from the interior receptacle 192*b*. Unlike the upper socket 158*r*, which includes discrete ribs 196*a*-196*e* formed on each of the fingers 194*a*-194*e*, the lower socket 158*s* includes a continuous rib 196*f* extending around the lower interior receptacle 192*b*. The lower rib 196*f* includes a distal end 198*f* that faces the lower barrier layer 168 in the web area 174. Like the upper ribs 196*a*-196*e*, the distal end 198*f* of the lower rib 196*f* may be spaced apart from the lower barrier layer 168 by a gap, such that the web area 174 contacts the distal end 198*f* when the sole structure 100*a* is compressed. Thus, the web area 174 is spaced apart from the distal ends 198*a*-198*e* of the upper ribs 196*a*-196*e* and the distal end 198*f* of the lower rib 196*f* such that the ribs 196*a*-196*f* provide secondary support after initial compression of the sole structure 100*a*.

The lower fingers 194*f*-194*j* extend radially outwardly from an outer periphery of the lower rib 196*f*. The lower fingers 194*f*-194*j* are offset from the upper fingers 194*a*-194*e*. Particularly, the lower fingers 194*f*-194*j* are configured to be disposed between adjacent ones of the lower peripheral pillars 158*f*-158*j* to support the peripheral chamber 172 between the lobes 182*a*-182*e*. Here, the lower fingers 194*f*-194*j* each includes a concave channel 199*f*-199*j* configured to support the portion of the lower barrier layer 168 forming the peripheral chamber 172 between the lobes 182*a*-182*e*, as shown in FIG. 21. Accordingly, the lower pillars 158*f*-158*j* and the channels 199*f*-199*j* of the lower fingers 194*f*-194*j* cooperate to support the entire lower portion of the peripheral chamber 172.

With reference to FIGS. 15-23, when the sole structure 100*a* is assembled, the bladder 108 is received within the cavity 156 such that each of the chambers 170, 172 is disposed between opposing support surfaces 160*f*-160*j*, 160*m*-160*s* of the lower and upper supports 158*f*-158*j*, 158*m*-158*s*. Particularly, the peripheral chamber 172 is supported between the upper peripheral pillars 158*m*-158*q* and the lower peripheral pillars 158*f*-158*j*, and the interior chamber 170 is supported between the upper socket 158*r* and the lower socket 158*s*. Accordingly, the interior chamber 170 is engaged by the resilient materials of the cushioning element 110*a* and lower socket 158*s*, while the peripheral chamber 172 is engaged by the more rigid materials of the cradle 112*a*.

Figure 17:
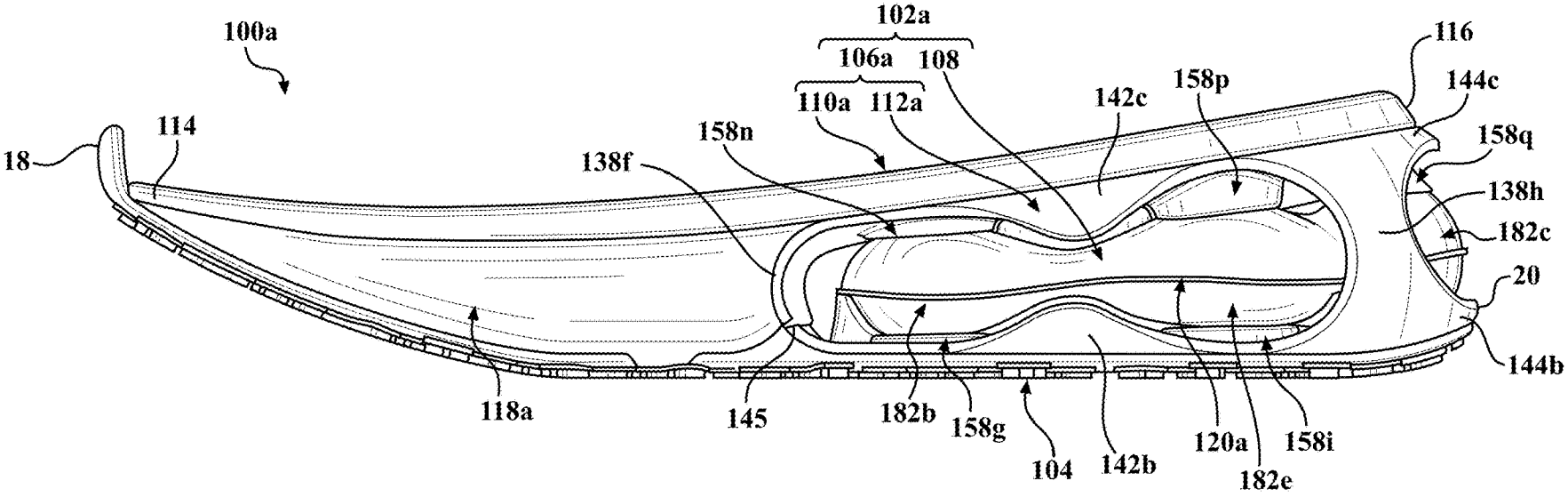
FIG. 17 is a medial side elevation view of the sole structure of FIG. 15.
Figure 18:
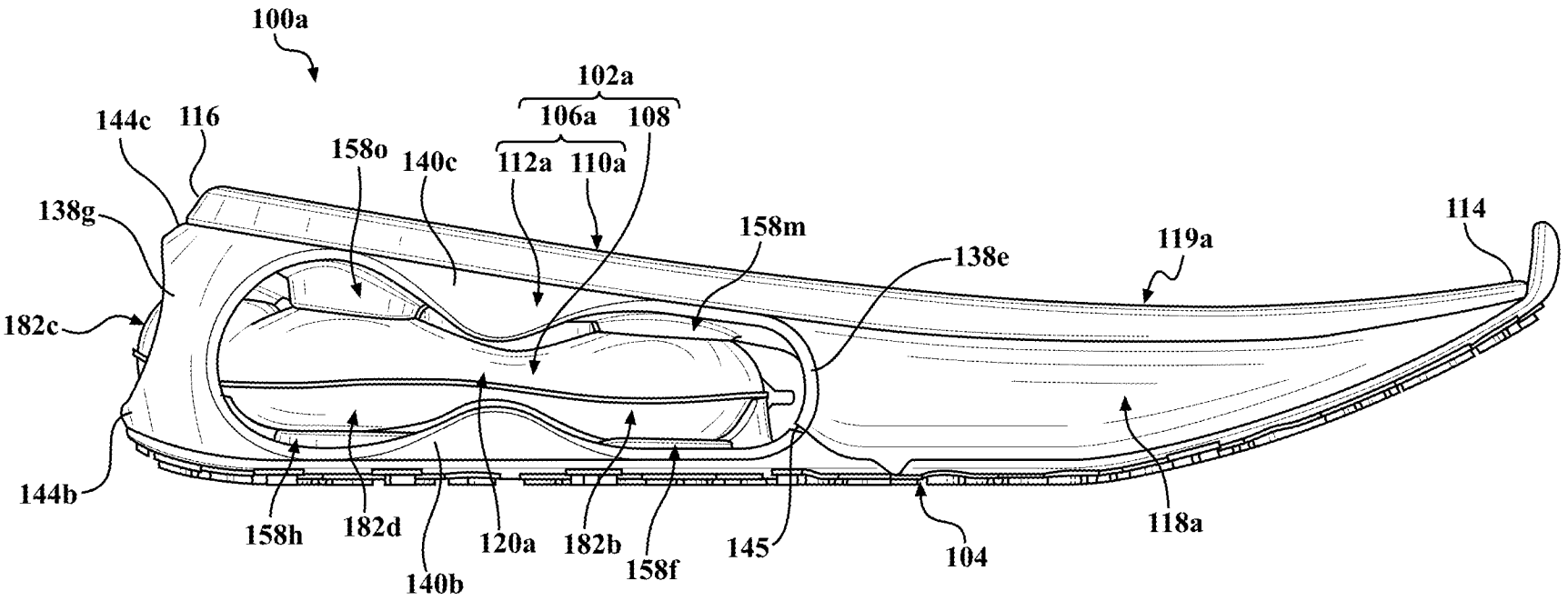
FIG. 18 is a lateral side elevation view of the sole structure of FIG. 15.
Figure 19:
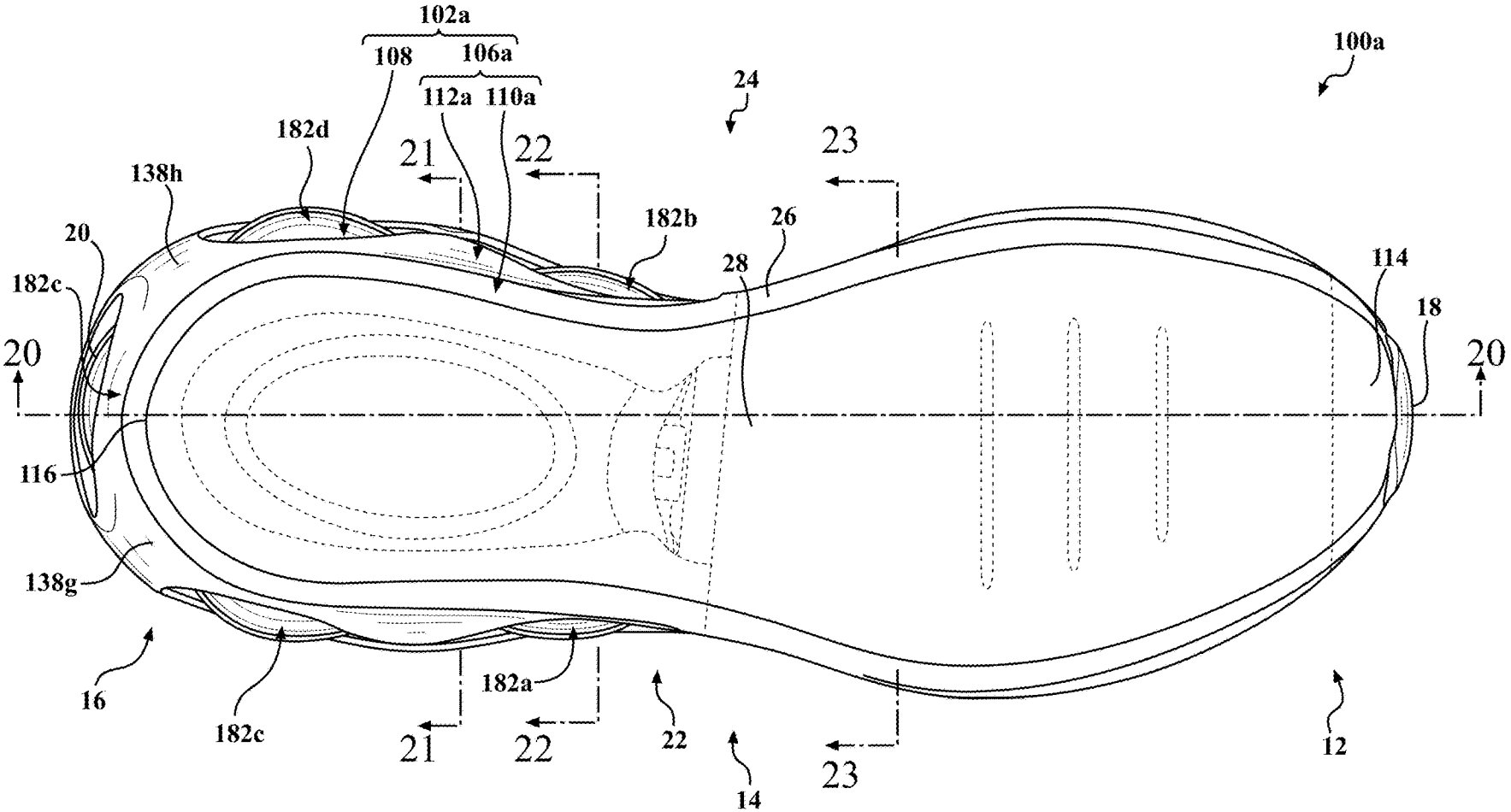
FIG. 19 is a top plan view of the sole structure of FIG. 15.
Figure 20:
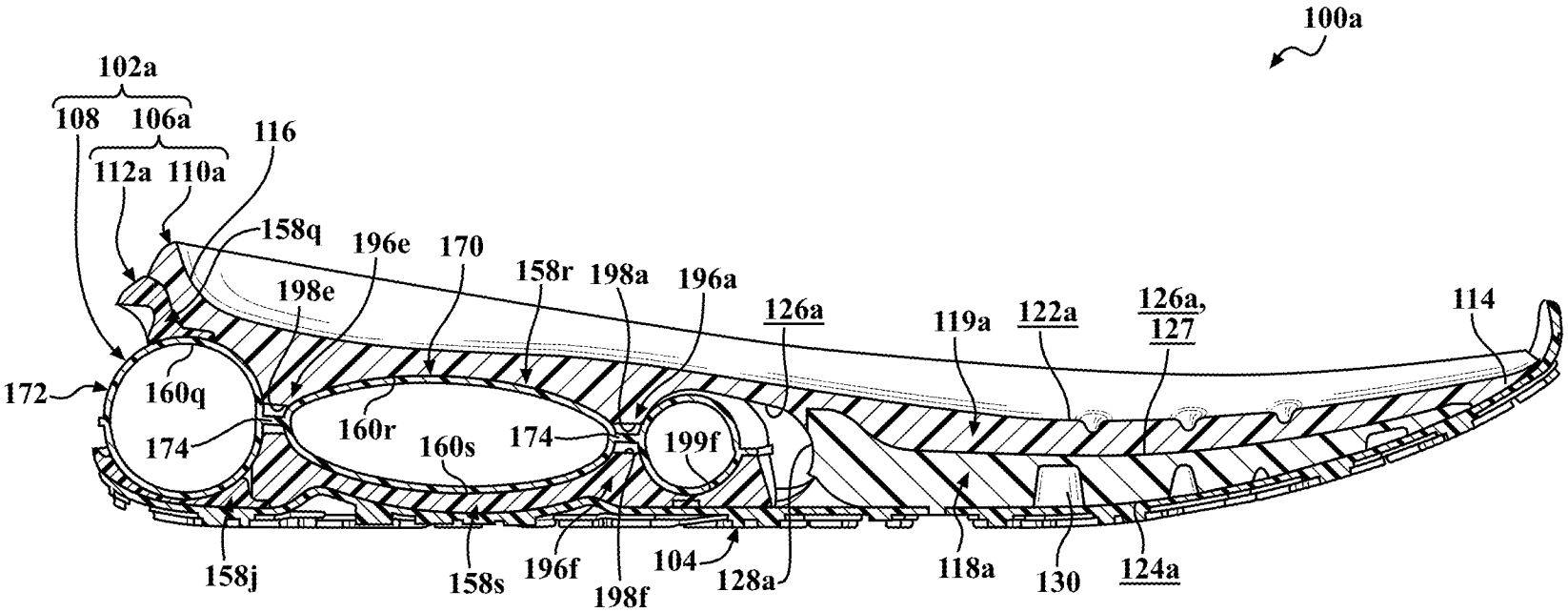
FIG. 20 is a cross-sectional view of the sole structure of FIG. 15, taken along Line 20-20 of FIG. 19.

In the illustrated example, the peripheral pillars 158*f*-158*j*, 158*m*-158*q* are arranged to engage respective ones of the lobes 182*a*-182*e* of the peripheral chamber 172. For example, as best shown in FIGS. 17 and 18, the lateral anterior lobe 182*a* (FIG. 18) is interposed between the first upper peripheral pillar 158*m* and the first lower peripheral pillar 158*f*, while the medial anterior lobe 182*b* (FIG. 17) is interposed between the second upper peripheral pillar 158*n* and the second lower peripheral pillar 158*g*. As best shown in FIG. 20, the posterior lobe 182*c* is interposed between the fifth upper peripheral pillar 158*q* and the fifth lower peripheral pillar 158*j*. Referring to FIGS. 17 and 18, the lateral intermediate lobe 182*d* is interposed between the third upper peripheral pillar 158*o* and the third lower peripheral pillar 158*h* (FIG. 18), and the medial intermediate lobe 182*e* is interposed between the fourth upper peripheral pillar 158*p* and the fourth lower peripheral pillar 158*i* (FIG. 17).

By supporting the peripheral chamber 172 in the foregoing manner, the thickest portions of the peripheral chamber 172 (i.e., the intermediate portions 188*a*-188*e* of the lobes 182*a*-182*e*) are discretely supported between the protruding support surfaces 160*f*-160*j*, 160*m*-160*q* of the pillars 158*f*-158*j*, 158*m*-158*q* within the cavity 156. However, as shown, portions of the peripheral chamber 172 between the intermediate portions 188*a*-188*e* are spaced inwardly from the upper and the outer periphery of the peripheral chamber 172 is also exposed. Accordingly, when the lobes 182*a*-182*e* are compressed by the pillars 158*f*-158*j*, 158*m*-158*q*, the pressure within the peripheral chamber 172 will increase and may cause the peripheral chamber 172 to deform in the narrower portions and/or along the outer periphery. Allowing the peripheral chamber 172 to deform under the point loads of the pillars 158*m*-158*k* provides progressive responsiveness as the fluid within the peripheral chamber 172 is redistributed and the barrier layers 168 react.

The following Clauses provide exemplary configurations for an article of footwear, a bladder for an article of footwear, or a sole structure for an article of footwear described above.

Clause 1: A sole structure for an article of footwear, the sole structure including a chassis having a cavity and a plurality of pillars extending into the cavity, a bladder disposed within the cavity and including one or more chambers, each of the one or more chambers supported by at least one of the pillars.

Clause 2: The sole structure of Clause 1, wherein the chassis includes a first plurality of the pillars extending from a first side of the cavity and a second plurality of the pillars extending towards the first plurality of the pillars from a second side of the cavity.

Clause 3: The sole structure of Clause 2, wherein the bladder is supported between the first plurality of the pillars and the second plurality of the pillars.

Clause 4: The sole structure of any one of Clauses 1-3, wherein the one or more chambers of the bladder includes an interior chamber and a peripheral chamber at least partially surrounding the interior chamber.

Clause 5: The sole structure of Clause 4, wherein the peripheral chamber has a different pressure than the interior chamber.

Clause 6: The sole structure of Clause 4 or 5, wherein the plurality of pillars includes an interior pillar interfacing with the interior chamber, and a plurality of peripheral pillars interfacing with the peripheral chamber.

Clause 7: The sole structure of any one of Clauses 1-6, wherein the bladder includes a plurality of lobes, each of the lobes supported by a respective one of the pillars.

Clause 8: The sole structure of Clause 7, wherein each of the lobes is supported between a pair of the pillars.

Clause 9: The sole structure of any one of Clauses 1-8, wherein the chassis includes a cushioning element including at least one of the pillars and a cradle including two or more of the pillars.

Clause 10: The sole structure of Clause 9, wherein the cushioning element is formed of a first material and the cradle is formed of a second material having a greater hardness than the first material.

Clause 11: A sole structure for an article of footwear, the sole structure comprising including a cushioning element, a cradle at least partially received within the cushioning element, the cradle defining a portion of a cavity and including a plurality of first pillars extending into the cavity, and a bladder at least partially received within the cradle and including one or more chambers supported by the plurality of first pillars.

Clause 12: The sole structure of Clause 11, wherein the cradle includes a first plurality of the first pillars extending from a first side of the cradle and a second plurality of the first pillars extending towards the first plurality of the first pillars from a second side of the cradle.

Clause 13: The sole structure of Clause 12, wherein the bladder is supported between the first plurality of the first pillars and the second plurality of the first pillars.

Clause 14: The sole structure of any one of Clauses 11-13, wherein the one or more chambers of the bladder includes an interior chamber and a peripheral chamber at least partially surrounding the interior chamber.

Clause 15: The sole structure of Clause 14, wherein the peripheral chamber has a different pressure than the interior chamber.

Clause 16: The sole structure of any one of Clauses 11-15, wherein plurality of first pillars includes a plurality of first pillars arranged in a peripheral region of the sole structure.

Clause 17: The sole structure of any one of Clauses 11-16, wherein the bladder includes a plurality of lobes, each of the lobes supported by a respective one of the first pillars.

Clause 18: The sole structure of Clause 17, wherein each of the lobes is supported between a pair of the first pillars.

Clause 19: The sole structure of any one of Clauses 11-17, wherein the cushioning element includes a second pillar disposed in an interior region of the sole structure, the plurality of first pillars supporting a first one of the chambers of the bladder and the second pillar supporting a second one of the chambers of the bladder.

Clause 20: The sole structure of any one of Clauses 11-19, wherein the cushioning element is formed of a first material and the cradle is formed of a second material having a greater hardness than the first material.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a bladder including a peripheral chamber including a plurality of lobes extending around a periphery of the bladder; and a cradle surrounding at least a portion of the bladder and including:

an upper segment extending along one of a medial side of the sole structure and a lateral side of the sole structure and including a first projection; and a lower segment extending along the one of the medial side of the sole structure and the lateral side of the sole structure and including a second projection, the first projection and the second projection each defining a portion of a peripheral surface of the sole structure and extending along the one of the medial side of the sole structure and the lateral side of the sole structure and toward one another, spaced apart from one another, and each disposed between adjacent lobes of the plurality of lobes.

2. The sole structure of claim 1, wherein the cradle includes a first plurality of pillars extending from the upper segment, pillars of the first plurality of pillars in contact with respective lobes of the plurality of lobes.

3. The sole structure of claim 2, wherein the cradle includes a second plurality of pillars extending from the lower segment, pillars of the second plurality of pillars in contact with the respective lobes of the plurality of lobes.

4. The sole structure of claim 1, wherein the cradle includes a first plurality of pillars extending from the lower segment, pillars of the first plurality of pillars in contact with respective lobes of the plurality of lobes.

5. The sole structure of claim 1, wherein the bladder includes an interior chamber at least partially surrounded by the peripheral chamber.

6. The sole structure of claim 5, wherein the peripheral chamber has a different pressure than the interior chamber.

7. The sole structure of claim 5, further comprising a plurality of pillars including an interior pillar interfacing with the interior chamber, and a plurality of peripheral pillars interfacing with the peripheral chamber.

8. The sole structure of claim 7, wherein the plurality of peripheral pillars extend from the cradle.

9. The sole structure of claim 8, further comprising a cushioning element configured to be disposed between the cradle and the upper, the cushioning element defining the interior pillar.

10. The sole structure of claim 9, wherein the cushioning element is formed of a first material and the cradle is formed of a second material having a greater hardness than the first material.

11. A sole structure for an article of footwear having an upper, the sole structure comprising:

a bladder including a peripheral chamber including a plurality of lobes extending around a periphery of the bladder; and a cradle surrounding at least a portion of the bladder and including:

an upper segment extending along one of a medial side of the sole structure and a lateral side of the sole structure and including a first projection; and a lower segment extending along the one of the medial side of the sole structure and the lateral side of the sole structure and including a second projection, the first projection and the second projection each defining a portion of a peripheral surface of the sole structure and extending along the one of the medial side of the sole structure and the lateral side of the sole structure, being aligned with one another, being spaced apart from one another, and each disposed between adjacent lobes of the plurality of lobes.

12. The sole structure of claim 11, wherein the cradle further includes a first plurality of pillars extending from the upper segment, pillars of the first plurality of pillars in contact with respective lobes of the plurality of lobes.

13. The sole structure of claim 12, wherein the cradle further includes a second plurality of pillars extending from the lower segment, pillars of the second plurality of pillars in contact with the respective lobes of the plurality of lobes.

14. The sole structure of claim 11, wherein the cradle includes a first plurality of pillars extending from the lower segment, pillars of the first plurality of pillars in contact with respective lobes of the plurality of lobes.

15. The sole structure of claim 11, wherein the bladder includes an interior chamber at least partially surrounded by the peripheral chamber.

16. The sole structure of claim 15, wherein the peripheral chamber has a different pressure than the interior chamber.

17. The sole structure of claim 15, further comprising a plurality of pillars including an interior pillar interfacing with the interior chamber, and a plurality of peripheral pillars interfacing with the peripheral chamber.

18. The sole structure of claim 17, wherein the plurality of peripheral pillars extend from the cradle.

19. The sole structure of claim 18, further comprising a cushioning element configured to be disposed between the cradle and the upper, the cushioning element defining the interior pillar.

20. The sole structure of claim 19, wherein the cushioning element is formed of a first material and the cradle is formed of a second material having a greater hardness than the first material.

* * * * *